US012227854B2

(12) United States Patent
Brupbacher et al.

(10) Patent No.: US 12,227,854 B2
(45) Date of Patent: Feb. 18, 2025

(54) METHOD FOR FORMING BINDER-FREE REFRACTORY CARBIDE, NITRIDE AND BORIDE COATINGS WITH A CONTROLLED POROSITY

(71) Applicant: THE JOHNS HOPKINS UNIVERSITY, Baltimore, MD (US)

(72) Inventors: Michael Brupbacher, Catonsville, MD (US); Dajie Zhang, Baltimore, MD (US); Dennis Nagle, Arnold, MD (US)

(73) Assignee: THE JOHNS HOPKINS UNIVERSITY, Baltimore, MD (US)

( * ) Notice: Subject to any disclaimer, the term of this patent is extended or adjusted under 35 U.S.C. 154(b) by 239 days.

(21) Appl. No.: 17/821,483

(22) Filed: Aug. 23, 2022

(65) Prior Publication Data

US 2023/0050837 A1 Feb. 16, 2023

Related U.S. Application Data

(62) Division of application No. 15/524,632, filed as application No. PCT/US2015/059386 on Nov. 6, 2015, now abandoned.

(51) Int. Cl.
*C23C 4/134* (2016.01)
*C23C 4/08* (2016.01)
(Continued)

(52) U.S. Cl.
CPC ..... *C23C 4/134* (2016.01); *C23C 4/08* (2013.01); *C23C 4/11* (2016.01); *C23C 4/18* (2013.01);
(Continued)

(58) Field of Classification Search
CPC .. C23C 4/134; C23C 4/11; C23C 4/08; C23C 4/18; C23C 8/20; C23C 8/24
See application file for complete search history.

(56) References Cited

U.S. PATENT DOCUMENTS 3,271,181 A * 9/1966 Jewell ..... C23C 8/00 428/689
4,097,353 A 6/1978 Kishida
(Continued)

FOREIGN PATENT DOCUMENTS

WO WO03072844 * 9/2003

OTHER PUBLICATIONS

Berger, L.; Stolle, S.; Gruner, W.; Wetzig, K.; "Investigation of the Carbothermal Reduction Process of Chromium Oxide by Micro-and Lab-scale Methods", International Journal of Refractory Metals & HArd Materials; 2001, vol. 19, p. 109-121.
(Continued)

*Primary Examiner* — Nathan T Leong
(74) *Attorney, Agent, or Firm* — MH2 Technology Law Group LLP

(57) ABSTRACT

The present invention is directed to methods for formation of refractory carbide, nitride, and boride coatings without use of a binding agent. The present invention is directed to methods of creating refractory coatings with controlled porosity. Refractory coatings can be formed from refractory metal, metal oxide, or metal/metal oxide composite refractory coating precursor of the 9 refractory metals encompassed by groups 4-6 and periods 4-6 of the periodic table; non-metallic elements (e.g. Si & B) and their oxides (i.e. $SiO_2$ & $B_2O_3$) are also pertinent. The conversion of the refractory coating precursor to refractory carbide, nitride or boride is achieved via carburization, nitridization, or boridization in the presence of carbon-containing (e.g. $CH_4$), nitrogen containing (e.g. $NH_3$), and boron-containing (e.g. $B_2H_6$) gaseous species. Any known technique of applying the refractory coating precursor can be used. The porosity of resultant refractory coatings is controlled through composi-
(Continued)

tional manipulation of composite refractory coating precursors.

19 Claims, 34 Drawing Sheets

(51) Int. Cl.

| | |
|---|---|
| ***C23C 4/11*** | (2016.01) |
| ***C23C 4/18*** | (2006.01) |
| ***C23C 8/02*** | (2006.01) |
| ***C23C 8/08*** | (2006.01) |
| ***C23C 8/20*** | (2006.01) |
| ***C23C 8/24*** | (2006.01) |
| ***C23C 18/08*** | (2006.01) |
| ***C23C 24/04*** | (2006.01) |

(52) U.S. Cl.
CPC ..... *C23C 8/02* (2013.01); *C23C 8/08* (2013.01); *C23C 8/20* (2013.01); *C23C 8/24* (2013.01); *C23C 18/08* (2013.01); *C23C 24/04* (2013.01)

(56) References Cited

U.S. PATENT DOCUMENTS

| | | | | |
|---|---|---|---|---|
| 5,350,719 | A | 9/1994 | Narula et al. | |
| 5,683,226 | A | 11/1997 | Clark et al. | |
| 5,789,077 | A * | 8/1998 | Nakahama | C23C 10/02 427/376.6 |
| 6,095,107 | A | 8/2000 | Kloft | |
| 2007/0153965 | A1 * | 7/2007 | Choi | G21F 5/008 376/417 |
| 2007/0166999 | A1 | 7/2007 | Vaartstra | |
| 2010/0084051 | A1 * | 4/2010 | Mizuno | C22C 38/06 148/319 |
| 2012/0040188 | A1 | 2/2012 | Davies et al. | |

OTHER PUBLICATIONS

Translation of JP 04-088159A, generated on Nov. 21, 2019 with J-Pat Plat website (http://www.j-platpat.inpit.go.jp/).

P. Fauchais and A. Vardelle (2012). Thermal Sprayed Coatings Used Against Corrosion and Corrosive Wear, Advanced Plasma Spray Applications, Dr. Hamid Jazi (Ed.), ISBN: 978-953-51-0349-3, InTech.

Brupbacher, M., et al., "Synthesis and characterization of binder-free Cr3C2 coatings on nickel-based alloys for molten fluoride salt corrosion resistance", Journal of Nuclear Materials, (2015) vol. 461, pp. 215-220.

* cited by examiner

METHOD FOR FORMING BINDER-FREE REFRACTORY CARBIDE, NITRIDE AND BORIDE COATINGS WITH A CONTROLLED POROSITY

CROSS REFERENCE TO RELATED APPLICATIONS

This application is a divisional application of U.S. patent application Ser. No. 15/524,632 filed on May 5, 2017, the disclosure of which is incorporated by reference herein in its entirety. The Ser. No. 15/524,632 application is a national stage conversion under 35 U.S.C. § 371 of PCT Application No. PCT/US2015/059386, filed Nov. 6, 2015, which claims the benefit of U.S. Provisional Application 62/192,668, filed on Jul. 15, 2015, and U.S. Provisional Application 62/076,073, filed on Nov. 6, 2014, the disclosures of which are also hereby incorporated by reference herein in their entireties.

GOVERNMENT SUPPORT

This invention was made with government support under grant number 101630 awarded by the Department of Energy. The government has certain rights in the invention.

FIELD OF THE INVENTION

The present invention relates generally to coatings. More particularly, the present invention relates to a method for forming binder-free refractory carbide, nitride, and boride coatings with a controlled porosity.

BACKGROUND OF THE INVENTION

The Gen-IV molten salt fast reactor (MSFR) concept poses a significant challenge in materials selection as candidate materials for containment of secondary heat transfer media are required to exhibit sufficient mechanical properties and microstructural phase stability after prolonged exposure to dynamic molten fluoride salts in the temperature range of 700-850° C. While nickel-based alloys, in particular those derived from the Ni—Cr—W system, have demonstrated significant microstructural phase stability and retention of mechanical properties after long-term exposure to the aforementioned temperature range, there is concern in the literature regarding the microstructural response of such alloys to molten fluoride salt immersion. Refractory carbides, however, have been shown to form on graphite components used to investigate the corrosion resistance of nickel-based alloys, which suggests that this particular subset of refractory materials may be thermodynamically stable in molten fluoride salts. Consequently, modification of the surface of nickel-based alloys via the deposition of refractory carbide coatings offers a viable pathway to withstanding the extreme environment envisioned in the MSFR concept.

$Cr_3C_2$, one of three stable carbide phases found in the Cr—C system, has conventionally been deposited by means of thermal spray techniques. Inherent to the deposition of $Cr_3C_2$ via thermal spray processes such as atmospheric plasma spray (APS), high velocity oxy-fuel (HVOF), high velocity air-fuel (HVAF), and, in particular, cold gas dynamic spray (CGDS) is the use of a solid solution NiCr binder phase to promote bonding between the spray material and the substrate during coating buildup. A considerable amount of work has been conducted in recent years both to improve and to characterize the microstructure and resulting material properties of thermally-sprayed $Cr_3C_2$—NiCr cermet coatings. Nonetheless, the presence of the NiCr binder phase, along with the porous nature of thermally-sprayed materials, represents a significant concern when considering thermally-sprayed $Cr_3C_2$—NiCr cermet coatings for applications requiring molten fluoride salt corrosion resistance.

Research has shown that the predominant mechanism of molten fluoride salt corrosion on nickel-based alloys high in Cr content is the selective dealloying of Cr from the grain boundaries of the matrix phase (γ), which typically consists of a solid solution of Ni, Cr and other common alloying elements. Exposure of thermally-sprayed $Cr_3C_2$—NiCr cermet coatings to a molten fluoride salt environment would likely result in the selective dealloying of Cr from the NiCr binder phase, followed by the formation of voids via vacancy diffusion and coalescence. The development of an interconnected network of voids, and subsequent exposure of the underlying nickel-based alloy to corrosion, would plausibly be facilitated by the complex pore structure characteristic of thermally-sprayed materials.

Also of significant concern is the effect of the NiCr binder phase on the long-term high-temperature microstructural phase stability of thermally-sprayed $Cr_3C_2$—NiCr cermet coatings. The thermodynamically-driven transformation of $Cr_3C_2$ to $Cr_7C_3$ as a result of the direct interaction between $Cr_3C_2$ particles and the NiCr binder phase has been observed at temperatures slightly above the expected operating range of MSFR. This transformation is highly unfavorable in applications requiring molten fluoride salt corrosion resistance, as void formation due to Cr consumption in the NiCr binder phase and spallation due to specific volume change are conceivable over the service lifetime of the coating.

The mechanisms and the kinetics of the reduction of chromium oxide ($Cr_2O_3$) powder and pressed pellets with methane-containing gas have been studied extensively and the body of related work is a testament to the industrial importance of this process. Although the details of proposed mechanisms describing reduction vary, one central notion prevails—namely, a particular phase of chromium carbide, $Cr_3C_2$, is the end product of complete conversion. Also, there is agreement on the pronounced effect that methane concentration has on the rate of reduction—above a critical methane concentration the deposition of carbon can strongly retard $Cr_3C_2$ formation. In addition, the relatively low temperatures and short reaction times observed by many authors for complete conversion to $Cr_3C_2$ compared to solid-state carbothermal reduction processing highlight the usefulness of exploiting a vapor-phase reducing agent. Beyond the production of $Cr_3C_2$, this material plays a significant role as a component in feedstock powder for cermet thermal spray coatings.

In order to facilitate bonding between the feedstock powder and the substrate during spraying, a metallic binder phase (e.g. NiCr) is used for the deposition of $Cr_3C_2$ via thermal spray techniques such as high velocity oxy-fuel (HVOF). Significant effort examining the behavior of HVOF $Cr_3C_2$—NiCr cermet coatings in diverse end-use conditions has shown that the functionalities of these coatings are heavily influenced by the presence of the NiCr binder phase. For example, for erosion performance, one of two erosion mechanisms predominately affected the NiCr binder phase in turn degrading coating integrity. Similarly, hot corrosion in molten oxide salt environments was limited by oxidation of the NiCr binder phase. For tribology applications, the size and the distribution of $Cr_3C_2$ particles within the NiCr binder phase affected the abrasive wear resistance, suggesting that variations in cohesion between these differing materials contributed to the measured wear rate fluctuations. These characteristics of HVOF $Cr_3C_2$—NiCr cermet coatings and the deposition requirements for $Cr_3C_2$ suggest that a carbide coating formation process which takes advantage of thermal spray technologies without requiring the use of a NiCr binder phase could produce coatings with improved performance for a range of applications.

Accordingly, there is a need in the art for a system and method for forming refractory carbide, nitride, boride or other material coatings without metallic binders via reduction of thermally-sprayed refractory coating precursors, and also having a controlled porosity, in order to prevent corrosion in systems and devices.

SUMMARY OF THE INVENTION

The foregoing needs are met, to a great extent, by the present invention which includes a method of forming a refractory coating comprising: the application of a refractory coating precursor to a substrate using any known technique, such as thermal spray; introducing gaseous reactants; thermal decomposition of the gaseous reactants.

In accordance with an aspect of the present invention, the method includes using one of a group consisting of refractory metal, metal oxide, and metal/metal oxide composite as a refractory coating precursor. The method also includes using one or more reactants selected from a group consisting of carbon-containing, nitrogen-containing, and boron containing gaseous species. The method includes forming one of a group consisting of refractory carbide, nitride, and boride coatings, or any combination thereof.

In accordance with another aspect of the present invention, binder-free refractory coatings with increased hardness and a controlled porosity are produced. This is achieved by reaction between the refractory coating precursor and the thermally decomposable gaseous reactants. The porosity of resultant refractory coatings is controlled by composition manipulation of composite refractory coating precursors.

In accordance with still another aspect of the present invention, a method of forming a uniformly-porous refractory coating including the application of a refractory coating precursor to a substrate using any known technique, such as thermal spray. The method includes introducing gaseous reactants and a thermal decomposition of the gaseous reactants. The method also includes using the porous refractory matrix as a scaffold for the formation of a multi-functional coating.

In accordance with yet another aspect of the present invention, the method includes using one of a group consisting of refractory metal, metal oxide, and metal/metal oxide composite as a refractory coating precursor. The method also includes using one or more reactants selected from a group consisting of carbon-containing, nitrogen-containing, and boron containing gaseous species. The method includes forming one of a group consisting of refractory carbide, nitride, and boride coatings, or any combination thereof. The method also includes creating the multi-functional coating using any known void-filling technique such as ambient-temperature sealing with organic sealants, filling with sol-gel processed inorganic ceramics, and liquid metal infiltration which requires significantly higher temperatures.

In accordance with another aspect of the present invention, binder-free refractory coatings with a controlled porosity are produced. This is achieved by reaction between the refractory coating precursor and the thermally decomposable gaseous reactants. The porosity of resultant refractory coatings is controlled by composition manipulation of composite refractory coating precursors. A porous refractory matrix provides a scaffold for the formation of a multi-functional coating. The multi-functional coating is created using any known void-filling technique such as ambient-temperature sealing with organic sealants, filling with sol-gel processed inorganic ceramics, and liquid metal infiltration which requires significantly higher temperatures.

BRIEF DESCRIPTION OF THE DRAWINGS

The accompanying drawings provide visual representations, which will be used to more fully describe the representative embodiments disclosed herein and can be used by those skilled in the art to better understand them and their inherent advantages. In these drawings, like reference numerals identify corresponding elements and:

FIG. 21A illustrates NiCr—Al used in the bond layer and FIG. 21B illustrates $Cr_2O_3$ used in the top coat.

FIG. 25A illustrates 0.1 h, FIG. 25B illustrates 0.2 h, and FIG. 25C illustrates 0.3 h.

DETAILED DESCRIPTION

Figure 1:
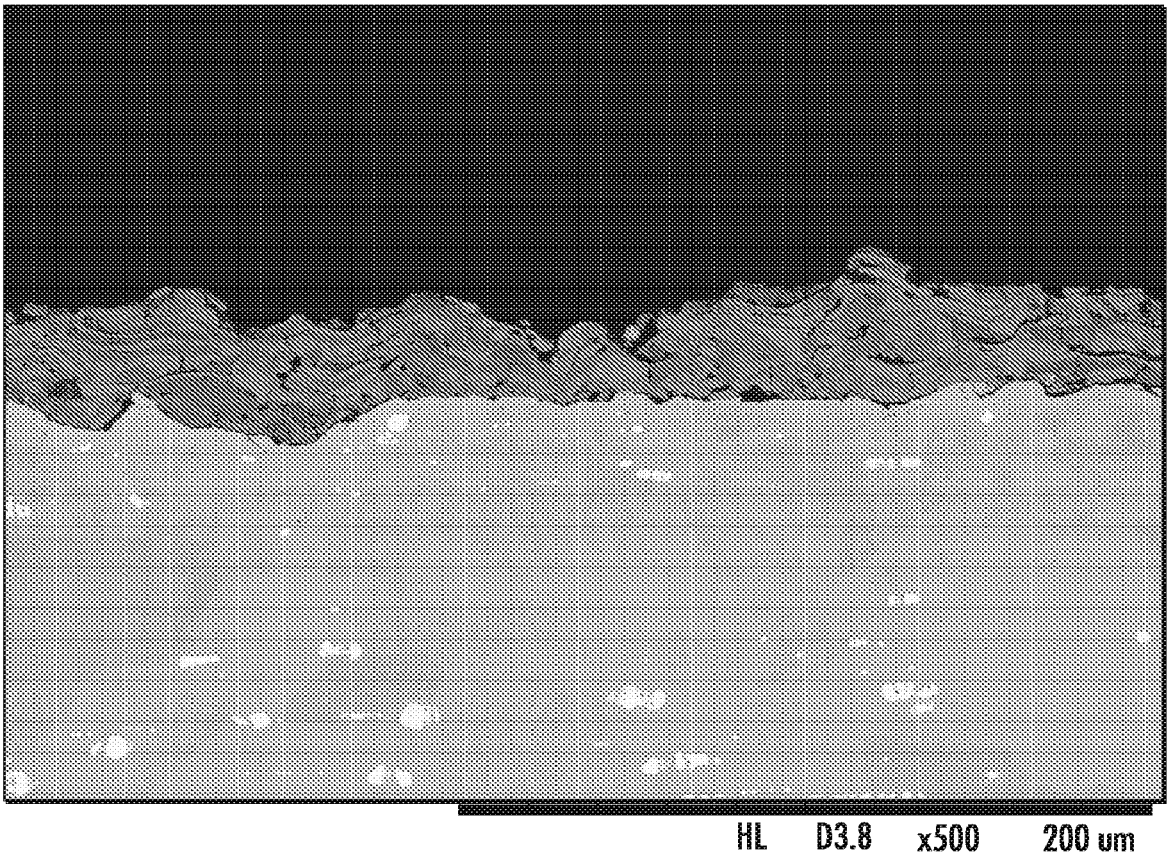
FIG. 1 illustrates an SEM cross-sectional image of an as-deposited plasma-sprayed Cr coating precursor.

The presently disclosed subject matter now will be described more fully hereinafter with reference to the accompanying Drawings, in which some, but not all embodiments of the inventions are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

The present invention is directed to a method for the formation of refractory carbide, nitride, and boride coatings without the use of a binding agent. The present invention is also directed to a method of creating refractory coatings with a controlled porosity. The refractory coatings can be formed from a refractory metal, metal oxide, or metal/metal oxide composite refractory coating precursor of the 9 refractory metals encompassed by groups 4-6 and periods 4-6 of the periodic table; non-metallic elements (e.g. Si & B) and their oxides (i.e. $SiO_2$ & $B_2O_3$) are also pertinent. The conversion of the refractory coating precursor to refractory carbide, nitride or boride is achieved via carburization, nitridization, or boridization in the presence of carbon-containing (e.g. $CH_4$), nitrogen containing (e.g. $NH_3$), and boron-containing (e.g. $B_2H_6$) gaseous species respectively. Any known technique of applying the refractory coating precursor can be used, such as thermal spray. The porosity of resultant refractory coatings is controlled through compositional manipulation of composite refractory coating precursors.

The present invention in part is directed to the carburization of plasma-sprayed Cr and $Cr_2O_3$ coating precursors for conversion to $Cr_3C_2$ coatings. While the example of the carburization of Cr and $Cr_2O_3$ coating precursors is used herein, this is understood to be merely exemplary, and any suitable combination of refractory coating precursors and gaseous reactants can be used. For example, the refractory coatings can be formed from a refractory metal, metal oxide, or metal/metal oxide composite refractory coating precursor of the 9 refractory metals encompassed by groups 4-6 and periods 4-6 of the periodic table; non-metallic elements (e.g. Si & B) and their oxides (i.e. $SiO_2$ & $B_2O_3$) are also pertinent. Reactants for carburization, nitridization, and boridization of refractory coating precursors include carbon-containing (e.g. $CH_4$), nitrogen-containing (e.g. $NH_3$), and boron-containing (e.g. $B_2H_6$) gaseous species respectively.

Figure 2:
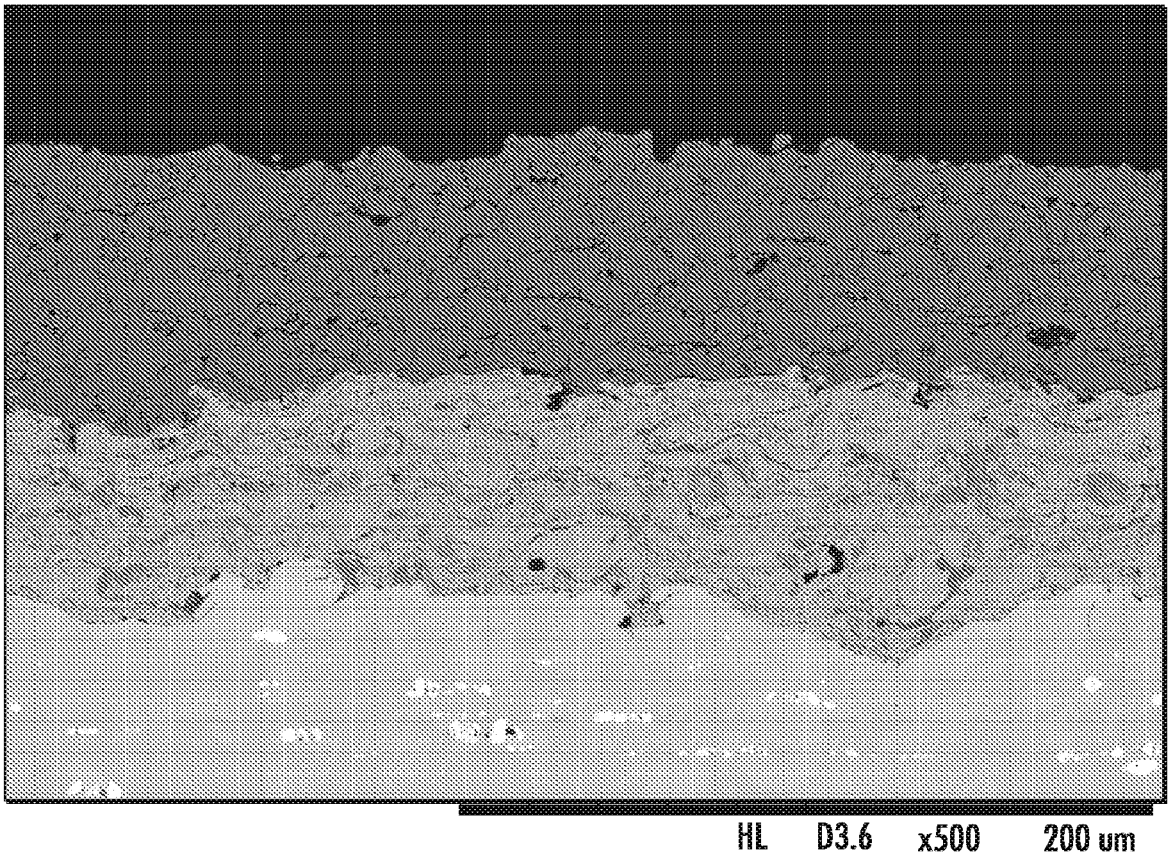
FIG. 2 illustrates an SEM cross-sectional image of an as-deposited plasma-sprayed $Cr_2O_3$ coating precursor.
Figure 3:
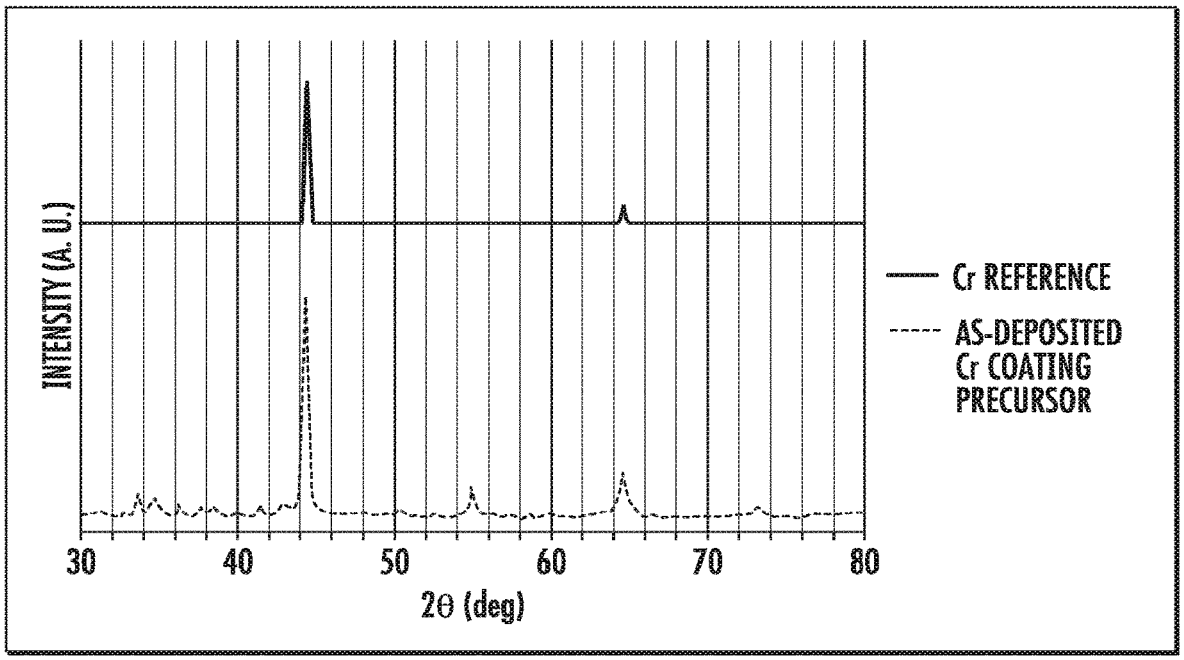
FIG. 3 illustrates a graphical view of an XRD pattern of an as-deposited plasma-sprayed Cr coating precursor.
Figure 4:
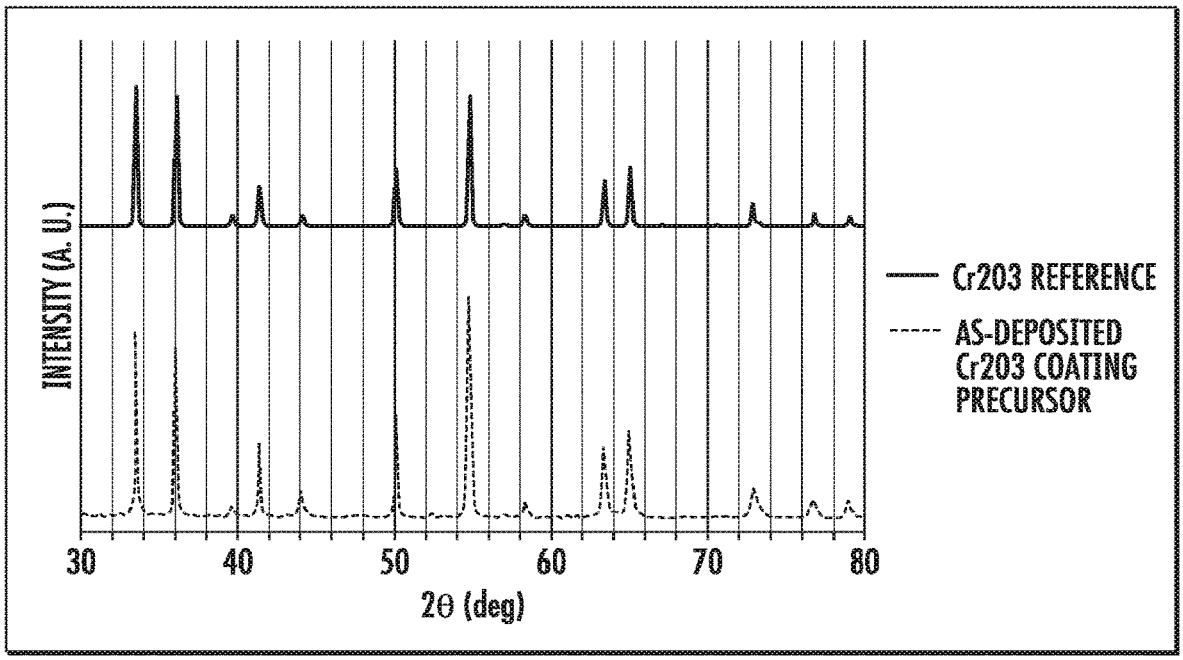
FIG. 4 illustrates a graphical view of an XRD pattern of an as-deposited plasma-sprayed $Cr_2O_3$ coating precursor.

FIGS. 1-4 show scanning electron microscopy (SEM) cross-sectional images and X-ray diffraction (XRD) patterns of as-deposited plasma-sprayed Cr and $Cr_2O_3$ coating precursors. More particularly, FIG. 1 illustrates an SEM cross-sectional image of an as-deposited plasma-sprayed Cr coating precursor and FIG. 2 illustrates an SEM cross-sectional image of an as-deposited plasma-sprayed $Cr_2O_3$ coating precursor. FIG. 3 illustrates a graphical view of an XRD pattern of an as-deposited plasma-sprayed Cr coating precursor and FIG. 4 illustrates a graphical view of an XRD pattern of an as-deposited plasma-sprayed $Cr_2O_3$ coating precursor.

As-deposited plasma-sprayed Cr and $Cr_2O_3$ coating precursors are then carburized in a horizontal quartz tube furnace for 6 h at 1000° C. in an Ar-20 vol. % $CH_4$ gas mixture with a volumetric flow rate of 250 $cm^3$/min. The system is purged for 3 h with 400 $cm^3$/min Ar prior to the initiation of the thermal cycle. Heating and cooling ramps were carried out at a rate of 400° C./hr and 200° C./hr respectively, with an atmosphere of 200 $cm^3$/min Ar. Ultra-high purity gas sources were used in conjunction with a Matheson Nanochem Purifilter to further reduce $O_2$ and $H_2O$ impurity levels (<0.1 ppb $O_2$ & $H_2O$). Gas mixture composition was regulated through the use of Alicat Series MC mass flow controllers. The following equations are likely the overall reaction pathways for the conversion of Cr and $Cr_2O_3$ coating precursors to $Cr_3C_2$ via carburization with methane-containing gas:

$$3Cr(s)+2CH_4(g)\rightarrow Cr_3C_2(s)+4H_2(g) \quad (1)$$

$$3Cr_2O_3(s)+13CH_4(g)\rightarrow 2Cr_3C_2(S)+9CO(g)+26H_2(g) \quad (2)$$

Figure 5:
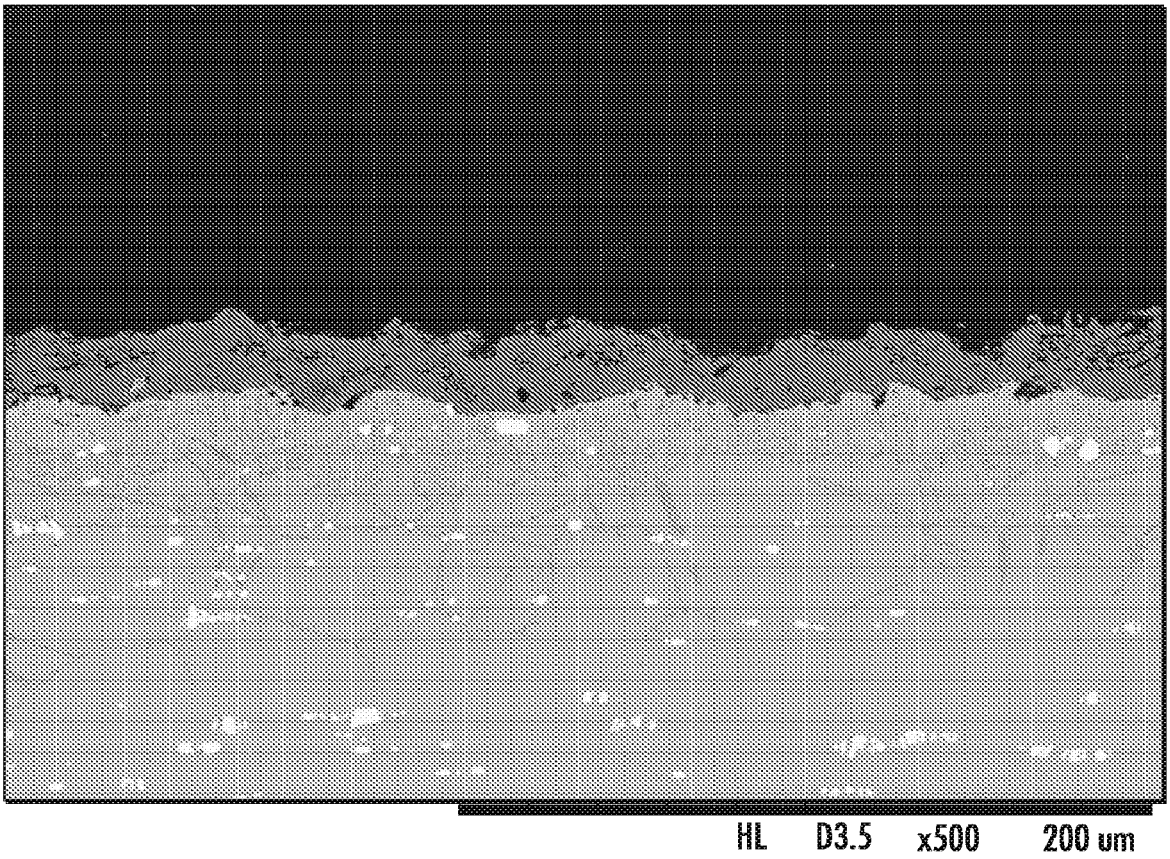
FIG. 5 illustrates an SEM cross-sectional image of a 6 h carburized plasma-sprayed Cr coating precursor.
Figure 6:
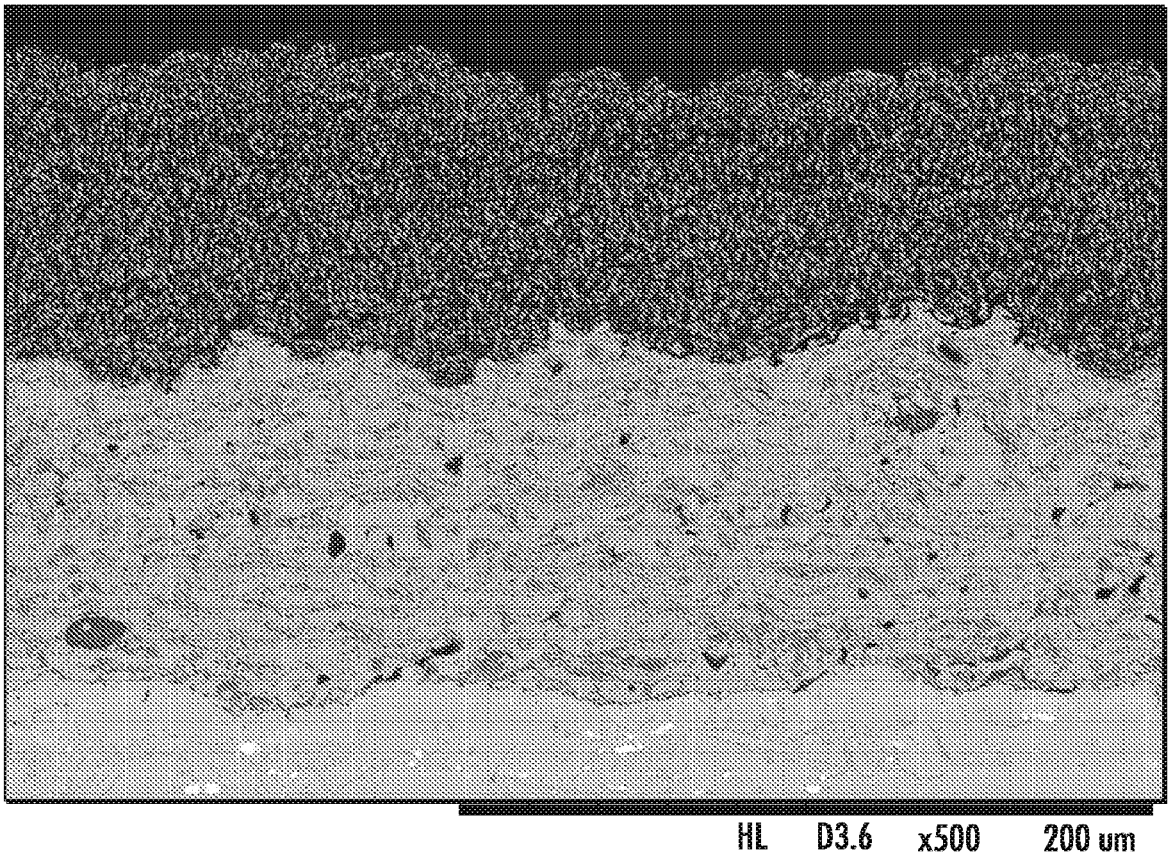
FIG. 6 illustrates an SEM cross-sectional image of a 6 h carburized plasma-sprayed $Cr_2O_3$ coating precursor.
Figure 7:
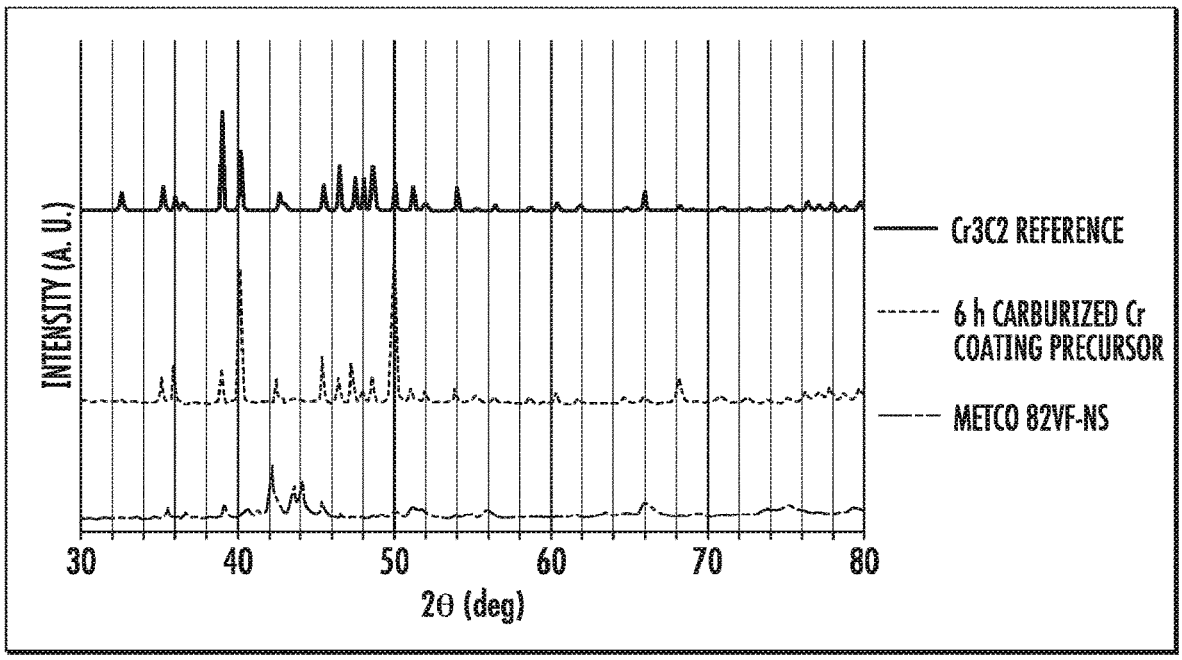
FIG. 7 illustrates a graphical view of an XRD pattern of a 6 h carburized plasma-sprayed Cr coating precursor.
Figure 8:
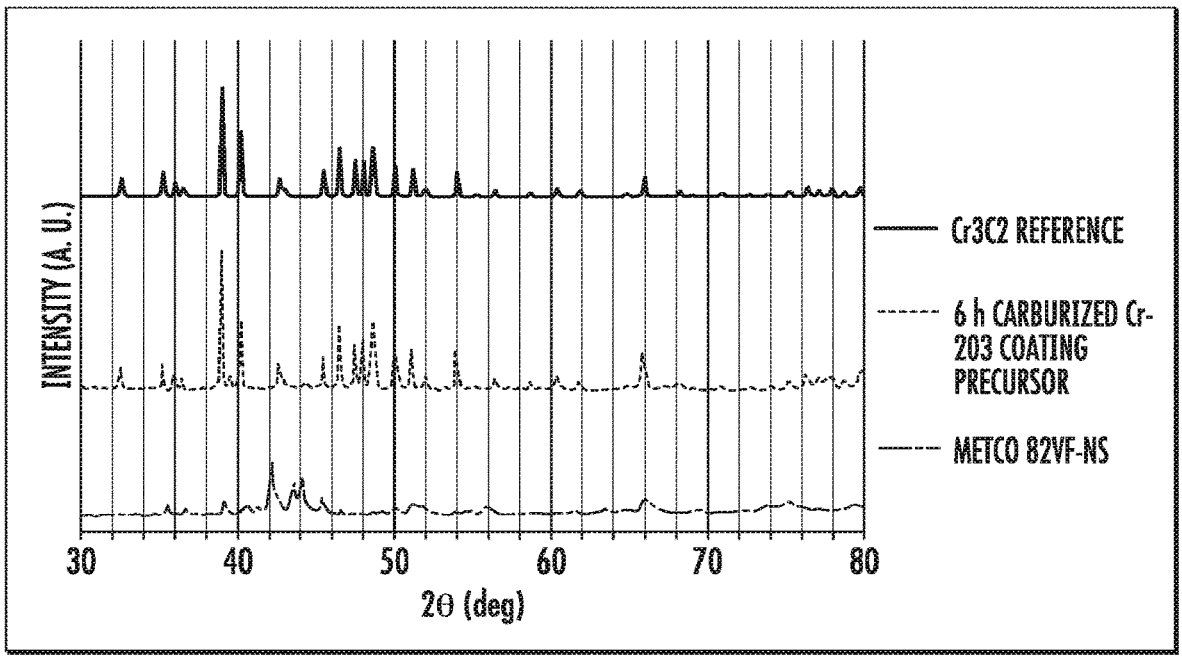
FIG. 8 illustrates a graphical view of an XRD pattern of a 6 h carburized plasma-sprayed $Cr_2O_3$ coating precursor.

SEM cross-sectional images and XRD patterns of plasma-sprayed Cr and $Cr_2O_3$ coating precursors treated by the carburization procedure described above are shown in FIGS. 5-8. More particularly, FIG. 5 illustrates an SEM cross-sectional image of a 6 h carburized plasma-sprayed Cr coating precursor and FIG. 6 illustrates an SEM cross-sectional image of a 6 h carburized plasma-sprayed $Cr_2O_3$ coating precursor. FIG. 7 illustrates a graphical view of an XRD pattern of a 6 h carburized plasma-sprayed Cr coating precursor and FIG. 8 illustrates a graphical view of an XRD pattern of a 6 h carburized plasma-sprayed $Cr_2O_3$ coating precursor. Included in FIGS. 7 and 8 is an XRD pattern of a plasma-sprayed commercial $Cr_3C_2$–7(Ni 20Cr) cermet coating, Metco 82VF-NS, which represents the industry standard for plasma-sprayed $Cr_3C_2$ coatings for comparison. It is apparent from FIGS. 7 and 8 that $Cr_3C_2$ coatings formed by the carburization of plasma-sprayed Cr and $Cr_2O_3$ coating precursors possess a degree of crystallinity which far surpasses that of the industry standard, as shown by the strong matching of peak locations with the $Cr_3C_2$ reference pattern and the intensities of such peaks relative to the background. Because, only peaks corresponding to $Cr_3C_2$ phase were detected, the coatings formed by the carburization of plasma-sprayed Cr and $Cr_2O_3$ coating precursors are binder-free $Cr_3C_2$ and possess properties intrinsic to the material in its pure state. Conversion of the compositional extremes (pure Cr & pure $Cr_2O_3$) of a proposed $Cr/Cr_2O_3$ composite coating precursor has been demonstrated under identical carburization conditions. This strongly implies that $Cr/Cr_2O_3$ composite coating precursors with compositions intermediate to the two extremes can be successfully converted under the same carburization conditions, with the notion that Cr and $Cr_2O_3$ behave in an ideal manner thermodynamically in the $Cr/Cr_2O_3$ composite coating precursor.

From inspection of FIGS. 5 and 6 it is clear that the carburization of plasma-sprayed Cr and $Cr_2O_3$ coating precursors produces $Cr_3C_2$ coatings with vastly different pore structures, which suggests the opportunity to control porosity through compositional manipulation of $Cr/Cr_2O_3$ composite coating precursors. The following equations give the fractional volume change associated with the conversion of Cr and $Cr_2O_3$ coating precursors to $Cr_3C_2$:

$$\frac{\Delta V}{V_{initial}}\Big|_{Cr\to Cr_3C_2} = \frac{V_{Cr_3C_2} - V_{Cr}}{V_{Cr}} = \frac{n_{Cr_3C_2}V_{m,Cr_3C_2} - n_{Cr}V_{m,Cr}}{n_{Cr}V_{m,Cr}} \tag{3}$$

$$\frac{\Delta V}{V_{initial}}\Big|_{Cr_2O_3\to Cr_3C_2} = \frac{V_{Cr_3C_2} - V_{Cr_2O_3}}{V_{Cr_2O_3}} = \frac{n_{Cr_3C_2}V_{m,Cr_3C_2} - n_{Cr_2O_3}V_{m,Cr_2O_3}}{n_{Cr_2O_3}V_{m,Cr_2O_3}} \tag{4}$$

where n and $V_m$ are the number of moles and molar volume of each component respectively. If equations (1) and (2) are expressed in terms of the number of moles of refractory coating precursor material:

$$n_{Cr}Cr(s) = \frac{2n_{Cr}}{3}CH_4(g) \to \frac{n_{Cr}}{3}Cr_3C_2(s) + \frac{4n_{Cr}}{3}H_2(g) \tag{5}$$

$$n_{Cr_2O_3}Cr_2O_3(s) + \frac{13n_{Cr_2O_3}}{3}CH_4(g) \to \frac{2n_{Cr_2O_3}}{3}Cr_3C_2(s) + 3n_{Cr_2O_3}CO(g) + \frac{26n_{Cr_2O_3}}{3}H_2(g) \tag{6}$$

the fractional volume change according to the stoichiometry of equations (5) and (6) is obtained by substitution:

$$\frac{\Delta V}{V_{initial}}\Big|_{Cr\to Cr_3C_2} = \frac{n_{Cr_3C_2}V_{m,Cr_3C_2} - n_{Cr}V_{m,Cr}}{n_{Cr}V_{m,Cr}} = \frac{\frac{n_{Cr}}{3}V_{m,Cr_3C_2} - n_{Cr}V_{m,Cr}}{n_{Cr}V_{m,Cr}} = \frac{\frac{V_{m,Cr_3C_2}}{3} - V_{m,Cr}}{V_{m,Cr}} \tag{7}$$

$$\frac{\Delta V}{V_{initial}}\Big|_{Cr\to Cr_3C_2} = \frac{\frac{26.95\frac{cm^3}{mol}}{3} - 7.27\frac{cm^3}{mol}}{7.27\frac{cm^3}{mol}} = 0.24 \tag{8}$$

$$\frac{\Delta V}{V_{initial}}\Big|_{Cr\to Cr_3C_2} = 0.24$$

$$\frac{\Delta V}{V_{initial}}\Big|_{Cr_2O_3\to Cr_3C_2} = \frac{n_{Cr_3C_2}V_{m,Cr_3c_2} - n_{Cr_2O_3}V_{m,Cr_2O_3}}{n_{Cr_2O_3}V_{m,Cr_2O_3}} =$$

-continued $$\frac{\frac{2n_{Cr_2O_3}}{3}V_{m,Cr_3C_2} - n_{Cr_2O_3}V_{m,Cr_2O_3}}{n_{Cr_2O_3}V_{m,Cr_2O_3}} = \frac{\frac{2V_{m,Cr_3C_2}}{3} - V_{m,Cr_2O_3}}{V_{m,Cr_2O_3}}$$

$$\frac{\Delta V}{V_{initial}}\Big|_{Cr_2O_3\to Cr_3C_2} = \frac{\frac{2*26.95\frac{cm^3}{mol}}{3} - 29.12\frac{cm^3}{mol}}{29.12\frac{cm^3}{mol}} = -0.38$$

$$\frac{\Delta V}{V_{initial}}\Big|_{Cr_2O_3\to Cr_3C_2} = -0.38$$

It is evident that the conversion of Cr to $Cr_3C_2$ is associated with a volume expansion, while the conversion of $Cr_2O_3$ to $Cr_3C_2$ is associated with a volume contraction. This fact allows porosity to be controlled through composition manipulation of $Cr/Cr_2O_3$ composite coating precursors, as opposed to controlling porosity by the variation of thermal spray deposition parameters, which is highly empirical in nature. The final total porosity ($TP_f$) in resultant $Cr_3C_2$ coatings is a function of the composition and initial total porosity ($TP_i$) of the $Cr/Cr_2O_3$ composite coating precursor:

$$TP_f = \frac{\left(\frac{TP_i}{1-TP_i} - 0.24\right)(1 - x_{Cr_2O_3})V_{m,Cr} + \left(\frac{TP_i}{1-TP_i} + 0.38\right)x_{Cr_2O_3}V_{m,Cr_2O_3}}{\left(1 + \frac{TP_i}{1-TP_i}\right)(1 - x_{Cr_2O_3})V_{m,Cr} + \left(1 + \frac{TP_i}{1-TP_i}\right)x_{Cr_2O_3}V_{m,Cr_2O_3}} \tag{9}$$

Figure 9:
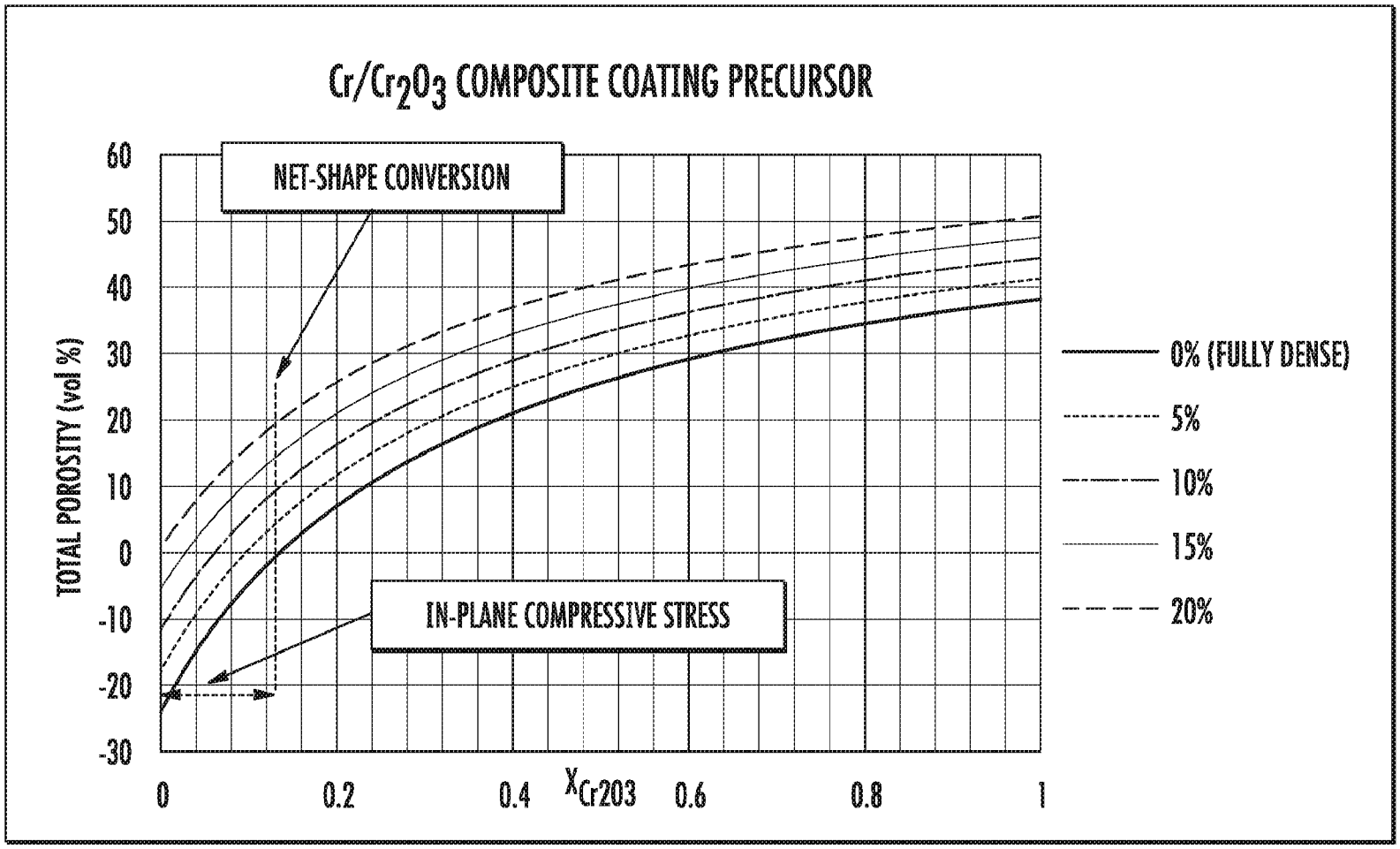
FIG. 9 illustrates a graphical view of final total porosity as a function of composition and initial total porosity.

The full derivation for equation (9) is provided below in paragraphs [0053]-[0057]. Because, thermally-sprayed coatings typically have an initial total porosity of 20% or less, the final total porosity of $Cr_3C_2$ coatings resulting from the carburization of $Cr/Cr_2O_3$ composite coating precursors with initial total porosities ranging from 0-20% has been plotted as a function of precursor composition. FIG. 9 illustrates a graphical view of final total porosity as a function of composition and initial total porosity.

One important aspect of the control of porosity in resultant coatings is the ability to achieve net-shape conversion. Net-shape conversion occurs when the final total porosity is equal to the initial total porosity, at a composition of $x_{Cr_2O_3}$=0.137. The composition for net-shape conversion has been indicated in FIG. 9. For compositions on the Cr-rich side of the net-shape composition a fully-dense $Cr_3C_2$ coating with "negative porosity" (in-plane compressive stress) is produced. This may translate to $Cr_3C_2$ coatings with hardness values exceeding that of the bulk material. While the numerical analysis above is dependent on the molar volumes of Cr, $Cr_2O_3$ and $Cr_3C_2$, the derivation of equation (9) is entirely general to porosity control by compositional manipulation of composite refractory coating precursors. Therefore, the above discussion is regarded as a proof of concept for controlling porosity of refractory carbide, nitride and boride coatings.

The initial total porosity (vol. %) of the $Cr/Cr_2O_3$ composite coating precursor is defined as follows:

$$TP_i = \frac{V_{porosity,i}}{V_{total,i}} = \frac{V_{porosity,i}}{V_{material,i} + V_{porosity,i}}$$

Rearranging for $V_{porosity,i}$ in terms of $TP_i$ and $V_{material,i}$:

$$V_{porosity,i} = \frac{TP_i}{1-TP_i} V_{material,i}$$

$$V_{material,i} = n_{Cr} V_{m,Cr} + n_{Cr_2O_3} V_{m,Cr_2O_3}$$

$$V_{porosity,i} = \frac{TP_i}{1-TP_i}\left(n_{Cr} V_{m,Cr} + n_{Cr_2O_3} V_{m,Cr_2O_3}\right)$$

$$V_{total,i} = n_{Cr} V_{m,Cr} + n_{Cr_2O_3} V_{m,Cr_2O_3} + \frac{TP_i}{1-TP_i}\left(n_{Cr} V_{m,Cr} + n_{Cr_2O_3} V_{m,Cr_2O_3}\right)$$

$$V_{total,i} = \left(1 + \frac{TP_i}{1-TP_i}\right) n_{Cr} V_{m,Cr} + \left(1 + \frac{TP_i}{1-TP_i}\right) n_{Cr_2O_3} V_{m,Cr_2O_3}$$

The final total porosity (vol. %) of the resultant $Cr_3C_2$ coating is defined as:

$$TP_f = \frac{V_{porosity,f}}{V_{total,f}}$$

Two assumptions are made, the first being that the total volume of the coating is unchanged during the conversion process. Hence:

$$V_{total,f} = V_{total,i}$$

$$V_{total,f} = \left(1 + \frac{TP_i}{1-TP_i}\right) n_{Cr} V_{m,Cr} + \left(1 + \frac{TP_i}{1-TP_i}\right) n_{Cr_2O_3} V_{m,Cr_2O_3}$$

It is also assumed that any volume changes associated with the conversion of Cr and $Cr_2O_3$ to $Cr_3C_2$ are manifest as the creation/annihilation of porosity. Implicit in this assumption is that volume changes associated with the conversion of Cr and $Cr_2O_3$ to $Cr_3C_2$ are not accommodated for by elastic/plastic strain in the resulting $Cr_3C_2$ coating. Accordingly:

$$V_{porosity,f} = (-0.24) n_{Cr} V_{m,Cr} + (0.38) n_{Cr_2O_3} V_{m,Cr_2O_3} + V_{porosity,i}$$

$$V_{porosity,f} = (-0.24) n_{Cr} V_{m,Cr} + (0.38) n_{Cr_2O_3} V_{m,Cr_2O_3} + \frac{TP_i}{1-TP_i}\left(n_{Cr} V_{m,Cr} + n_{Cr_2O_3} V_{m,Cr_2O_3}\right)$$

$$V_{porosity,f} = \left(\frac{TP_i}{1-TP_i} - 0.24\right) n_{Cr} V_{m,Cr} + \left(\frac{TP_i}{1-TP_i} + 0.38\right) n_{Cr_2O_3} V_{m,Cr_2O_3}$$

Therefore, the final result:

$$TP_f = \frac{\left(\frac{TP_i}{1-TP_i} - 0.24\right) n_{Cr} V_{m,Cr} + \left(\frac{TP_i}{1-TP_i} + 0.38\right) n_{Cr_2O_3} V_{m,Cr_2O_3}}{\left(1 + \frac{TP_i}{1-TP_i}\right) n_{Cr} V_{m,Cr} + \left(1 + \frac{TP_i}{1-TP_i}\right) n_{Cr_2O_3} V_{m,Cr_2O_3}}$$

$$TP_f = \frac{\left(\frac{TP_i}{1-TP_i} - 0.24\right)\left(1 - x_{Cr_2O_3}\right) V_{m,Cr} + \left(\frac{TP_i}{1-TP_i} + 0.38\right) x_{Cr_2O_3} V_{m,Cr_2O_3}}{\left(1 + \frac{TP_i}{1-TP_i}\right)\left(1 - x_{Cr_2O_3}\right) V_{m,Cr} + \left(1 + \frac{TP_i}{1-TP_i}\right) x_{Cr_2O_3} V_{m,Cr_2O_3}}$$

EXEMPLARY IMPLEMENTATIONS

Exemplary implementations of the present invention are described herein, in order to further illustrate the present invention. The exemplary implementation is included merely as an example and is not meant to be considered limiting. Any implementation of the present invention on any suitable subject known to or conceivable by one of skill in the art could also be used, and is considered within the scope of this application.

Haynes 230 (H230) alloy substrates were used with the nominal chemical composition provided in Table 1. Preparation of these substrates included abrasive blasting with 36-grit $Al_2O_3$ media at 80 psi followed by cleaning with compressed air. A plasma spray system (Metco 9 MB plasma gun, Bay State Surface Technologies Model 1200 powder feeder and Yaksawa America Motoman HP20 movement) was used for deposition of Cr and $Cr_2O_3$. The nominal specifications for the main chemical constituents of the feedstock powders are presented in Table 2 (Sulzer-Metco). The 43VF-NS feedstock powder was used as a bond layer for the Amdry 6420 coating. Deposition conditions for each feedstock powder are shown in Table 3. Substrates were cooled with compressed air during plasma spray deposition.

TABLE 1

Nominal chemical composition (wt. %) of H230 alloy.

| Ni | Cr | W | Mo | Fe | Co | Mn | Si | Al | C | La | B |
|---|---|---|---|---|---|---|---|---|---|---|---|
| 57 | 22 | 14 | 2 | 3 | 5 | 0.5 | 0.4 | 0.3 | .10 | .02 | .015 |

TABLE 2

Nominal feedstock powder specifications.

| Feedstock Powder | Chemical Composition (wt. %) | Particle Size (μm) |
|---|---|---|
| Amdry 50357 | 99.5% Cr | −45 |
| 43VF-NS | 76.3% Ni 19.5% Cr | −45 +5 |
| Amdry 6420 | 99.5% $Cr_2O_3$ | −45 +22 |

TABLE 3

APS deposition conditions.

| Feedstock Powder | Voltage (V) | Current (A) | Working Distance (in) | Traverse Speed (in/sec) | Step Size (in) |
|---|---|---|---|---|---|
| Amdry 50357 | 70 | 500 | 5 | 16.4 | 0.125 |
| 43VF-NS | 70 | 500 | 4 | 16.4 | 0.125 |
| Amdry 6420 | 70 | 500 | 2.75 | 16.4 | 0.125 |

Figure 10:
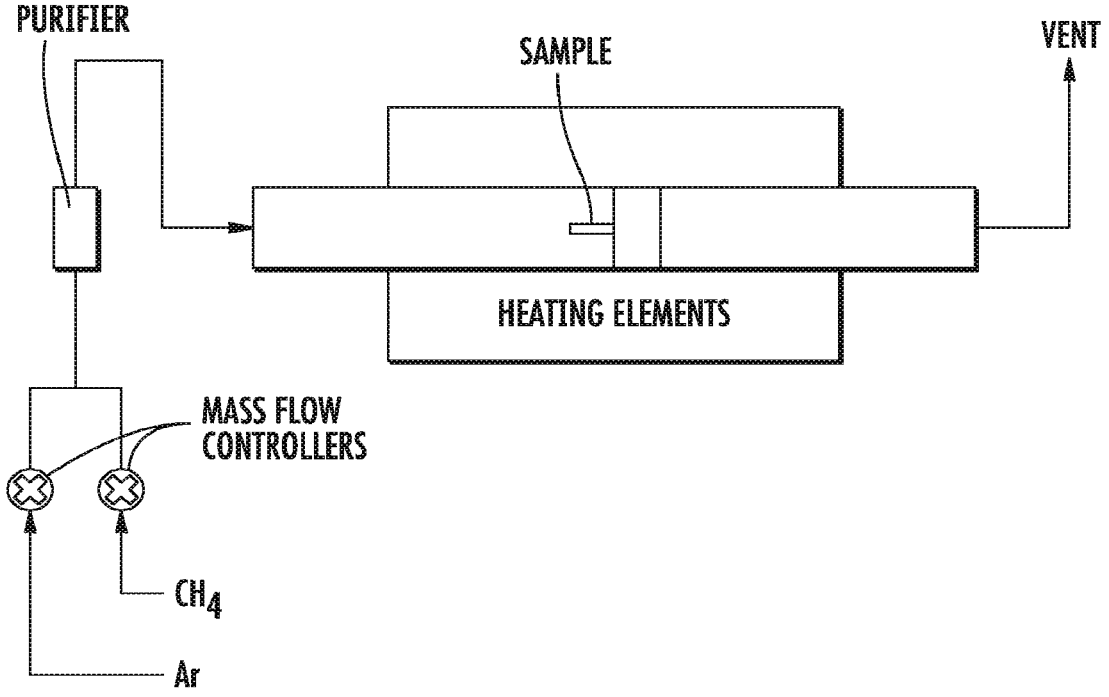
FIG. 10 illustrates a schematic diagram of a carburization apparatus, according to an embodiment of the present invention.

The plasma-sprayed Cr and $Cr_2O_3$ coatings were carburized using a flowing, methane-containing atmosphere (80 vol. % Ar with 20 vol. % $CH_4$; 250 $cm^3$/min) in a horizontal quartz tube furnace for 6 h at 1000° C. The system was purged for 3 h with 400 $cm^3$/min Ar prior to the initiation of the thermal cycle. Heating and cooling ramps were carried out at a rate of 400° C./h and 200° C./h respectively, with an atmosphere of 200 $cm^3$/min Ar. Ultra-high purity gas sources were used in conjunction with an in-line purifier (Matheson Nanochem Purifilter) to further reduce $O_2$ and $H_2O$ impurity levels (<0.1 ppb $O_2$ and $H_2O$). Gas mixture composition was regulated through the use of mass flow controllers (Alicat Scientific Series MC). A schematic illustration of the carburization apparatus used is shown in FIG. 10.

SEM cross-sectional images of the plasma-sprayed Cr and $Cr_2O_3$ coatings in FIGS. 1 and 2 show that these coatings are approximately 30 μm and 80 μm thick respectively. It is apparent from FIGS. 1 and 2 that the as-deposited Cr and $Cr_2O_3$ coatings contain both the globular voids and the interlamellar/microcrack porosity characteristics of thermally-sprayed materials. While an interconnected network of voids is certainly a detriment in the application of molten fluoride corrosion resistance, it may be advantageous in achieving through-thickness coating carburization. The overall reaction pathways for converting Cr and $Cr_2O_3$ coatings to $Cr_3C_2$ in a methane-containing atmosphere are likely described by the following equations:

$$3Cr(s)+2CH_4(g)\rightarrow Cr_3C_2(s)+4H_2(g) \quad (10)$$

$$3Cr_2O_3(s)+13CH_4(g)\rightarrow 2\ Cr_3C_2(s)+9CO(g)+26H_2(g) \quad (11)$$

Figure 11:
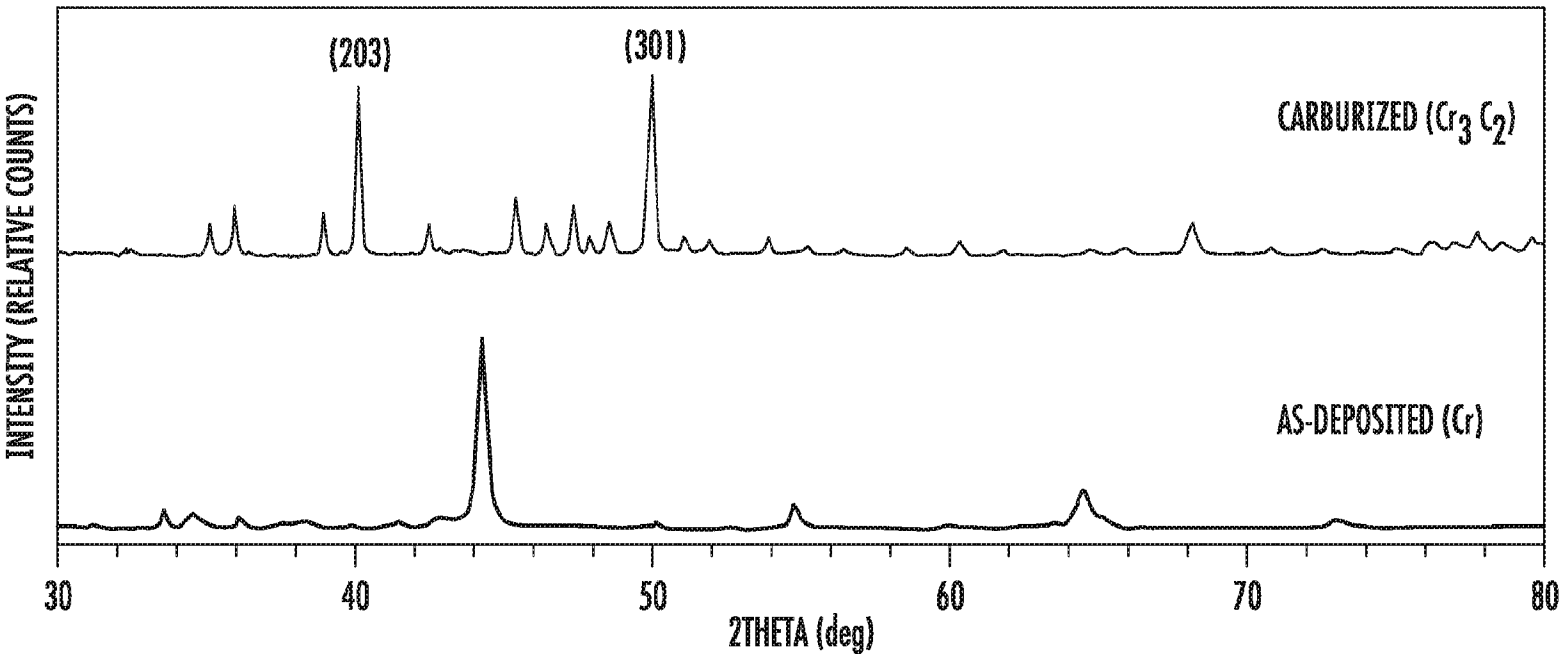
FIGS. 11 and 12 illustrate XRD patterns that indicate conversion of plasma-sprayed Cr and $Cr_2O_3$ coatings to $Cr_3C_2$ through equations (11) and (12).
Figure 12:
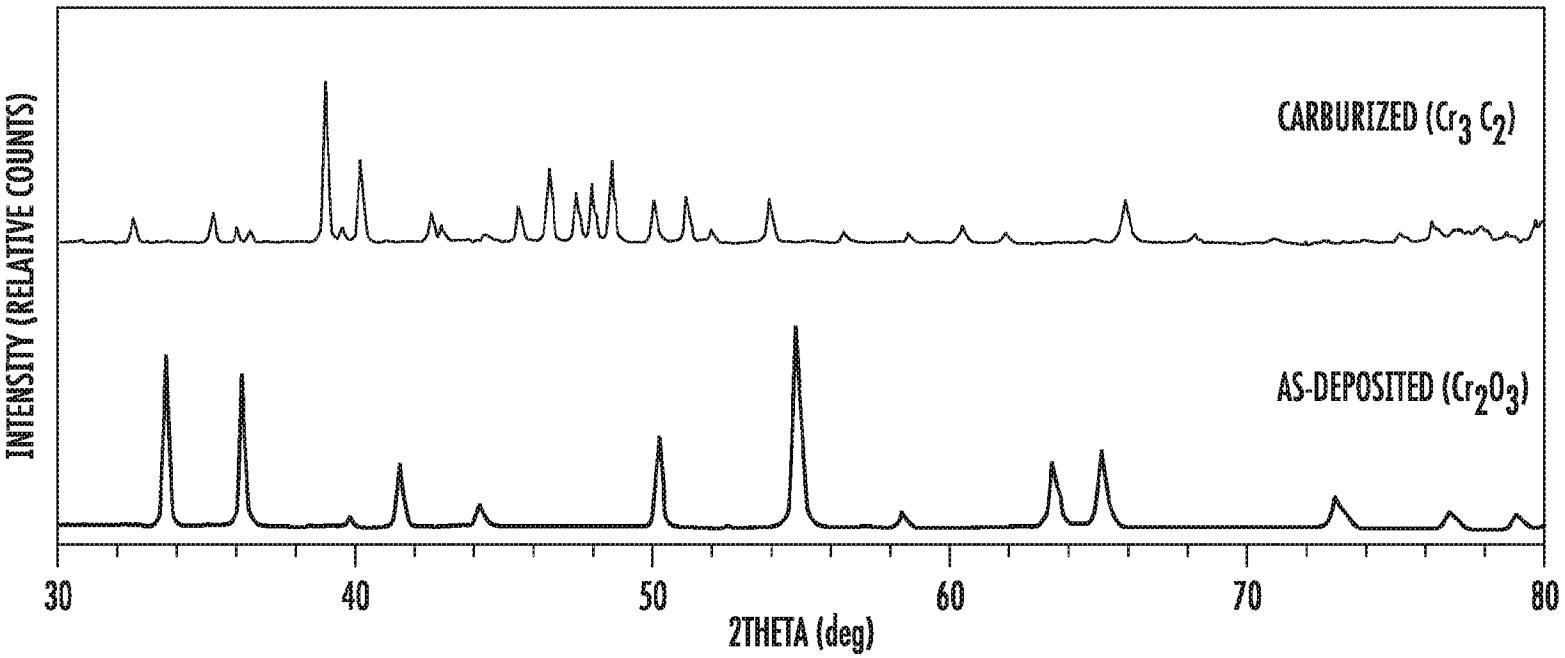

XRD patterns shown in FIGS. 11 and 12 indicate conversion of Cr and $Cr_2O_3$ coatings to $Cr_3C_2$ through these reactions. The $Cr_3C_2$ coating derived from the carburization of $Cr_2O_3$ resulted in an XRD pattern that closely matched that of untextured, polycrystalline $Cr_3C_2$ indicating that the carbide grains in this coating were randomly oriented. However, the $Cr_3C_2$ coating derived from the carburization of Cr displayed preferred orientation of the carbide grains evidenced by the relative heights of the peaks associated with diffraction from the (203) and (301) planes. FIGS. 5 and 6 illustrate SEM cross-sectional images of $Cr_3C_2$ coatings resulting from the carburization of Cr and $Cr_2O_3$ coatings.

Beyond texture differences indicated by XRD, inspection of FIGS. 5 and 6 shows that vastly different $Cr_3C_2$ coating microstructures result from the carburization of Cr coatings compared to the carburization of $Cr_2O_3$ coatings. This could be attributed in part to volumetric changes that occur during the conversion process. Conversion of Cr to $Cr_3C_2$ according to Eq. (10) is associated with a volume expansion of 23.57% and the conversion of $Cr_2O_3$ to $Cr_3C_2$ according to Eq. (11) is associated with a volume contraction of 38.30%. These considerable differences should result in correspondingly different $Cr_3C_2$ coating microstructures because coating dimensions are likely constrained by the substrate. The volume expansion associated with the conversion of Cr to $Cr_3C_2$ reduces the population of microcracks, initially present in the as-deposited Cr coating. Similarly, the highly porous $Cr_3C_2$ coating shown in FIG. 6 is a consequence of the large volume contraction associated with the conversion of $Cr_2O_3$ to $Cr_3C_2$.

In this work the carburization of plasma-sprayed Cr and $Cr_2O_3$ coatings on H230 alloy substrates has been demonstrated. Conversion of these coatings to $Cr_3C_2$ was accomplished by heating the coating-substrate materials in a high-temperature methane-containing atmosphere, allowing for decomposition of the methane and subsequent reaction between carbon and the coating materials. The microstructures of the $Cr_3C_2$ coatings depended on characteristic volumetric changes that occur during the conversion process. The results presented here suggest that the carburization of thermally-sprayed Cr coatings with engineered pore structures could be a viable pathway for synthesizing dense $Cr_3C_2$ coatings for applications requiring molten fluoride salt corrosion resistance. Corrosion studies on these coatings will be performed to assess the value of the processing technique presented here for producing coatings to be used in molten fluoride salt environments.

In another exemplary embodiment, as nickel-based alloys derived from the Ni—Cr—W system are currently considered to be leading candidates for MSFR materials selection and Haynes 230 (H230) exhibited the greatest weight loss per unit area in recent molten fluoride salt corrosion studies, this particular alloy was chosen as a substrate material in the present study. Table 4 shows the nominal chemical composition of H230 alloy.

TABLE 4

Nominal chemical composition (wt. %) of H230 alloy.

| Ni | Cr | W | Mo | Fe | Co | Mn | Si | Al | C | La | B |
|---|---|---|---|---|---|---|---|---|---|---|---|
| 57 | 22 | 14 | 2 | 3 | 5 | 0.5 | 0.4 | 0.3 | 0.10 | 0.02 | 0.015 |

H230 alloy was procured in sheet form (per AMS 5878 rev. C) with dimensions of 36"×12"×0.125" and cut into substrates measuring 3"×1"×0.125" via waterjet cutting. Substrates were sand blasted with 36 grit $Al_2O_3$ media and subsequently cleaned with compressed air prior to the deposition of Cr.

An atmospheric plasma spray (APS) system (Metco 9 MB plasma gun, Bay State Surface Technologies Model 1200 powder feeder and Yaksawa Motoman HP20 robot movement) and a cold gas dynamic spray (CGDS) system (Cold Gas Technology Kinetiks 4000 cold gas gun and powder feeder, Yaskawa Motoman MH50 robot movement) were used for the deposition of Cr. An SEM image and the specifications of the Cr feedstock powder used in this work are provided in FIG. 13 and Table 5 (Sulzer-Metco). APS and CGDS deposition conditions are presented in Tables 6 and 7.

TABLE 5

Nominal feedstock powder specifications.

| Feedstock Powder | Chemical Composition (wt. %) | Particle Size (μm) | Morphology |
|---|---|---|---|
| Amdry 50357 | 99.5% Cr | −45 | Spherical |

TABLE 6

APS deposition conditions.

| Feedstock Powder | Voltage (V) | Current (A) | Working Distance (mm) | Traverse Speed (mm/sec) | Step Size (mm) |
|---|---|---|---|---|---|
| Amdry 50357 | 70 | 500 | 127 | 416.67 | 3.18 |

TABLE 7

CGDS deposition conditions.

| Feedstock Powder | He Pressure (MPa) | He Temperature (K) | Working Distance (mm) | Traverse Speed (mm/sec) | Step Size (mm) |
|---|---|---|---|---|---|
| Amdry 50357 | 4 | 873.15 | 25.4 | 100 | 0.5 |

Coatings were carburized using a flowing, methane-containing atmosphere (80 vol. % Ar with 20 vol. % $CH_4$; 250

$cm^3$/min) in a horizontal quartz tube furnace for 6-12 h at 1000° C. The system was purged for 3 h with 400 $cm^3$/min Ar prior to the initiation of the thermal cycle. Heating and cooling ramps were carried out at a rate of 400° C./h and 200° C./h respectively, with an atmosphere of 200 $cm^3$/min Ar. Ultra-high purity gas sources were used in conjunction with an in-line purifier (Matheson Nanochem Purifilter) to further reduce 02 and $H_2O$ impurity levels (<0.1 ppb $O_2$ and $H_2O$). Gas mixture composition was regulated through the use of mass flow controllers (Alicat Scientific Series MC).

XRD data used for phase identification at various stages in coating development was collected with a Phillips X'Pert Pro MRD equipped with a Cu-Kα X-ray source and a programmable divergence slit. Irradiated length was held constant at 8 mm throughout the full 20 scan range.

General secondary electron SEM imaging of sample cross sections was performed on a Hitachi TM3000 tabletop microscope. Special care was taken in metallographic preparation of these sample cross sections in order to minimize distortion of the coating pore structure during sectioning and grinding/polishing. Samples were initially encapsulated/vacuum-impregnated with Buehler EpoThin low-viscosity epoxy at −20 in Hg gage pressure. Sectioning and semi-automatic grinding/polishing were then performed on a Buehler IsoMet 1000 and a Buehler EcoMet 3000/Buehler AutoMet 2000 using the Buehler Technical Notes for the metallographic preparation of thermally-sprayed ceramics as a guideline.

Secondary electron SEM cross-sectional images of free-standing sample cross sections overlaid with qualitative EDS X-ray mapping results were generated with a JEOL JSM-6700F field emission microscope equipped with a EDAX Apollo XL detector.

Figure 14:
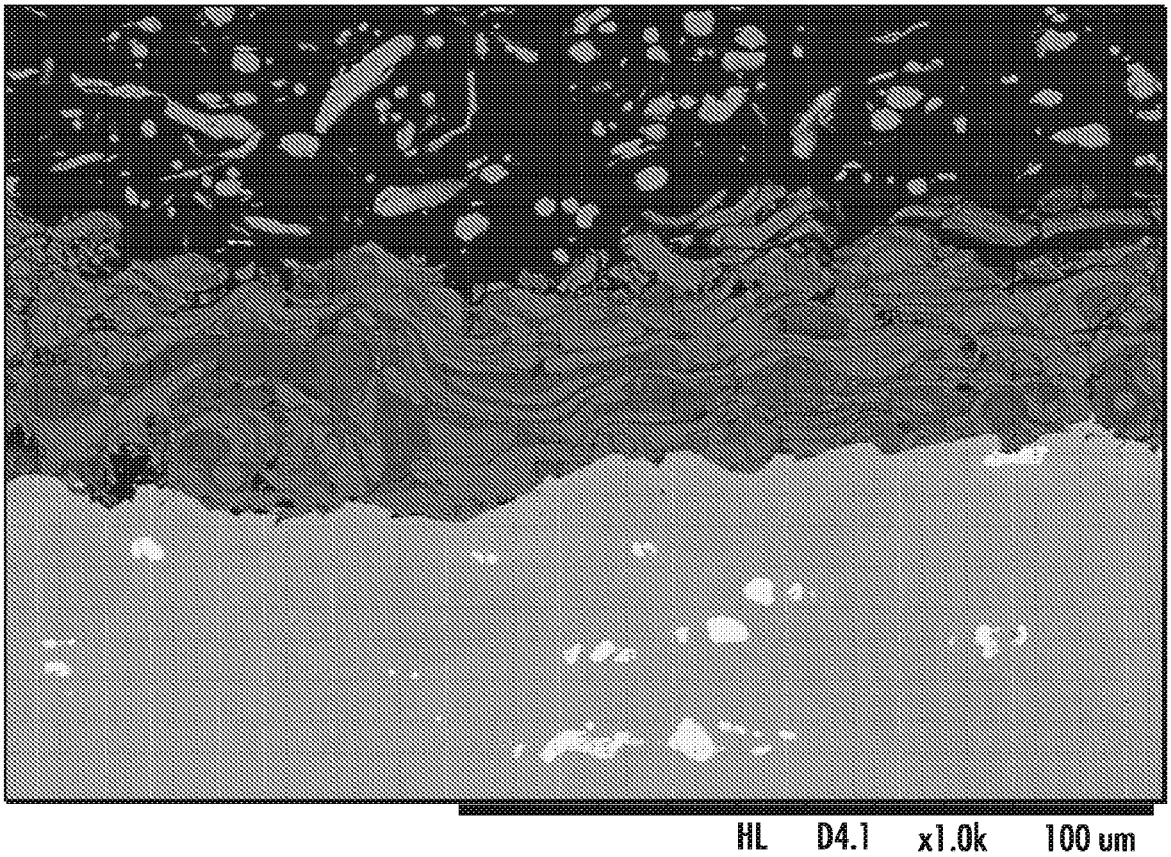
FIG. 14 illustrates an SEM cross-sectional image of a sprayed Cr coating deposited via APS.
Figure 15:
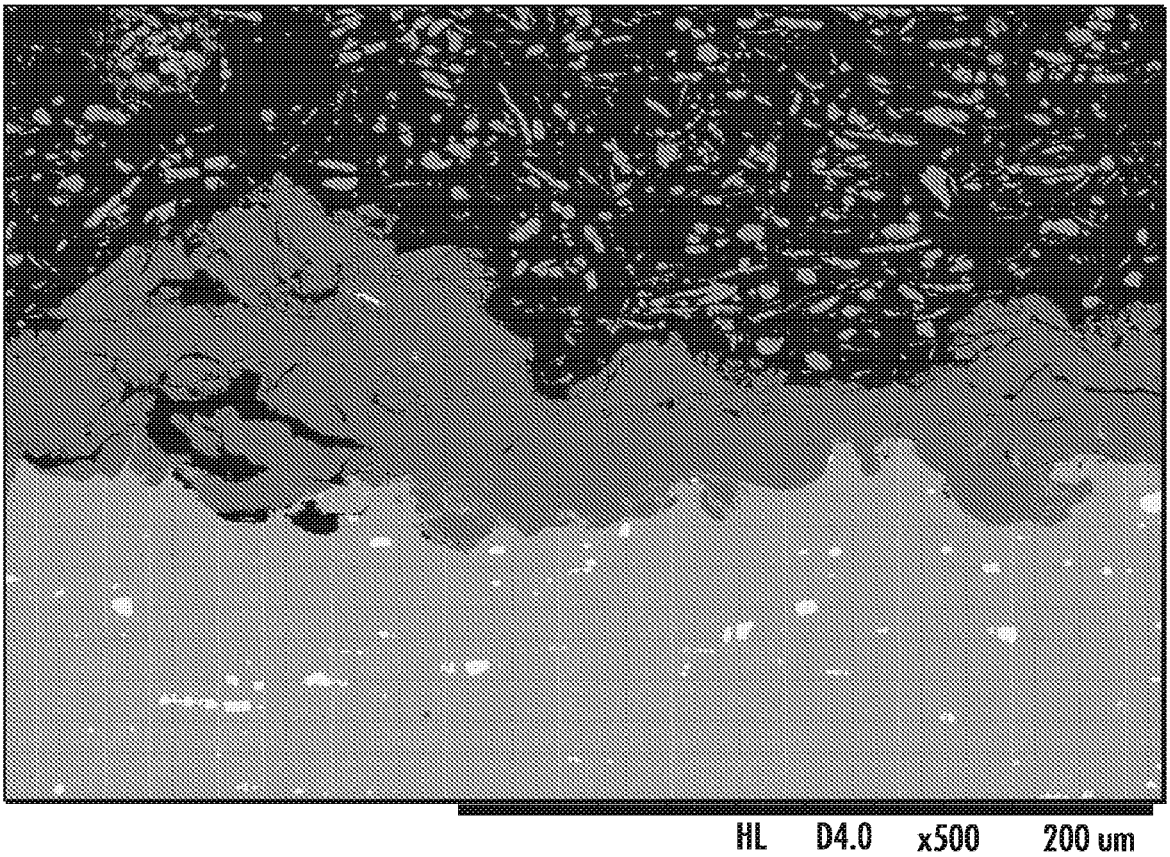
FIG. 15 illustrates an SEM cross-sectional image of a sprayed Cr coating deposited via CGDS.
Figure 16:
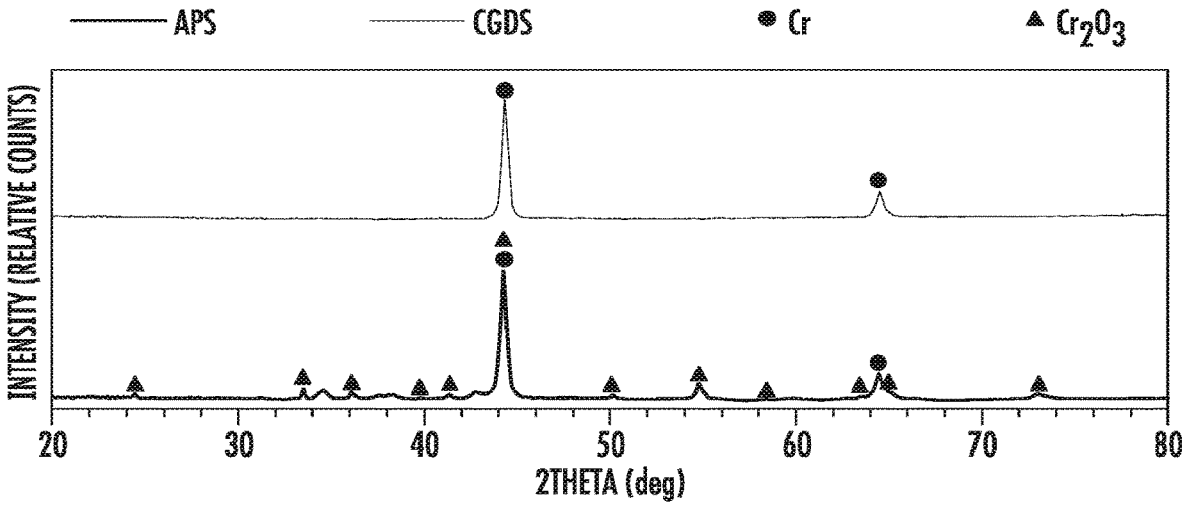
FIG. 16 illustrates an XRD comparison of as-deposited sprayed Cr coatings.

SEM cross-sectional images of as-deposited plasma-sprayed and cold-sprayed Cr are shown in FIGS. 14 and 15. A Cr coating of relatively uniform thickness (~30 μm) was obtained via APS, whereas significant coating thickness variation (~50-75 μm) was observed in cold-sprayed Cr in regions of increased porosity. Both the plasma-sprayed and the cold-sprayed Cr deposits display globular voids and interlamellar porosity, while intrallamelar microcracks oriented normal to the plane of the coating are only present in plasma-sprayed Cr. As intralamellar microcracking is characteristic of brittle materials deposited via "hot" thermal spray processes, this result suggests substantial oxidation of plasma-sprayed Cr feedstock material prior to splat quenching. Indeed, chromium oxide formation was detected in plasma-sprayed Cr via XRD, as illustrated in FIG. 16. Further confirmation of oxidation is seen in the varying degree of electron contrast in the lamallae of the plasma-sprayed Cr deposit of FIG. 14. No evidence of impurity phases resulting from the cold spray deposition process was identified in cold-sprayed Cr via SEM and XRD, as illustrated in FIG. 15 and FIG. 16.

Accounting for the presence of $Cr_2O_3$ in plasma-sprayed deposits, the conversion of sprayed Cr to $Cr_3C_2$ via carburization with methane-containing gas is likely described by the following overall reaction pathways:

$$3Cr(s)+2CH_4(g)\rightarrow Cr_3C_2(s)+4H_2(g) \quad (12)$$

$$3Cr_2O_3(s)+13CH_4(g)\rightarrow 2Cr_3C_2(s)+9CO(g)+26H_2(g) \quad (13)$$

Figure 17:
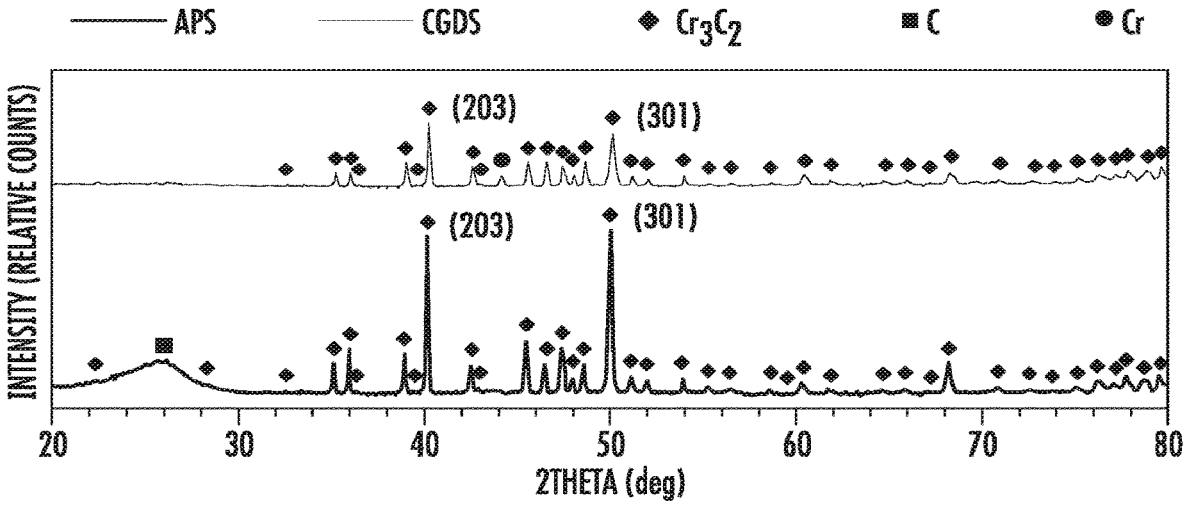
FIG. 17 illustrates an XRD comparison of 6 h carburized sprayed Cr coatings.
Figure 18:
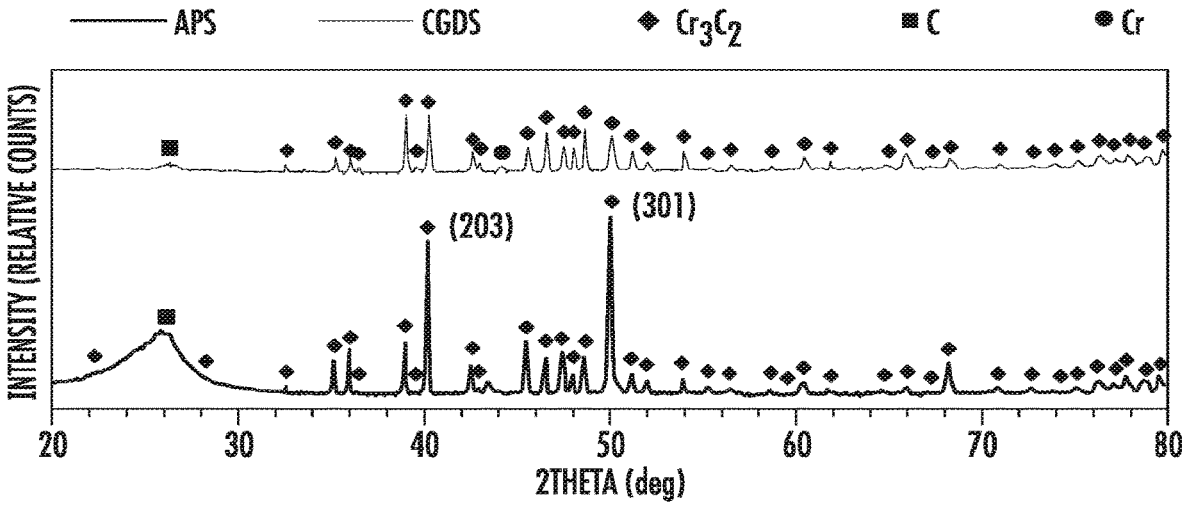
FIG. 18 illustrates an XRD comparison of 12 h carburized sprayed Cr coatings.

FIG. 17 illustrates the coating phase evolution after 6 h of carburization. With respect to FIG. 17, an XRD comparison of 6 h carburized sprayed Cr coatings is shown. Both plasma-sprayed and cold-sprayed Cr demonstrate successful conversion to $Cr_3C_2$ upon carburization, accompanied by a strong preference for growth of carbide grains oriented such that the [203] and [301] crystallographic directions are normal to the plane of the coating. An impurity phase, albeit of differing chemical composition, was also detected in each coating. Interestingly, a broad low-angle peak corresponding to amorphous carbon was identified in carburized plasma-sprayed Cr, with no such peak present in carburized cold-sprayed Cr. In the case of carburized cold-sprayed Cr, a low intensity peak corresponding to unconverted Cr was recognized. The coating phase evolution for a carburization time of 12 h is shown in FIG. 18. With respect to FIG. 18, an XRD comparison of 12 h carburized sprayed Cr coatings is shown.

No structural change in the carbide coating derived from plasma-sprayed Cr was discerned with additional carburization time. An intensification of the amorphous carbon peak is noted. In contrast, additional carburization of cold-sprayed Cr results in an XRD pattern with relative peak intensities closely matching that of randomly oriented $Cr_3C_2$, along with a reduction in the intensity of the peak corresponding to unconverted Cr.

Figure 19A:
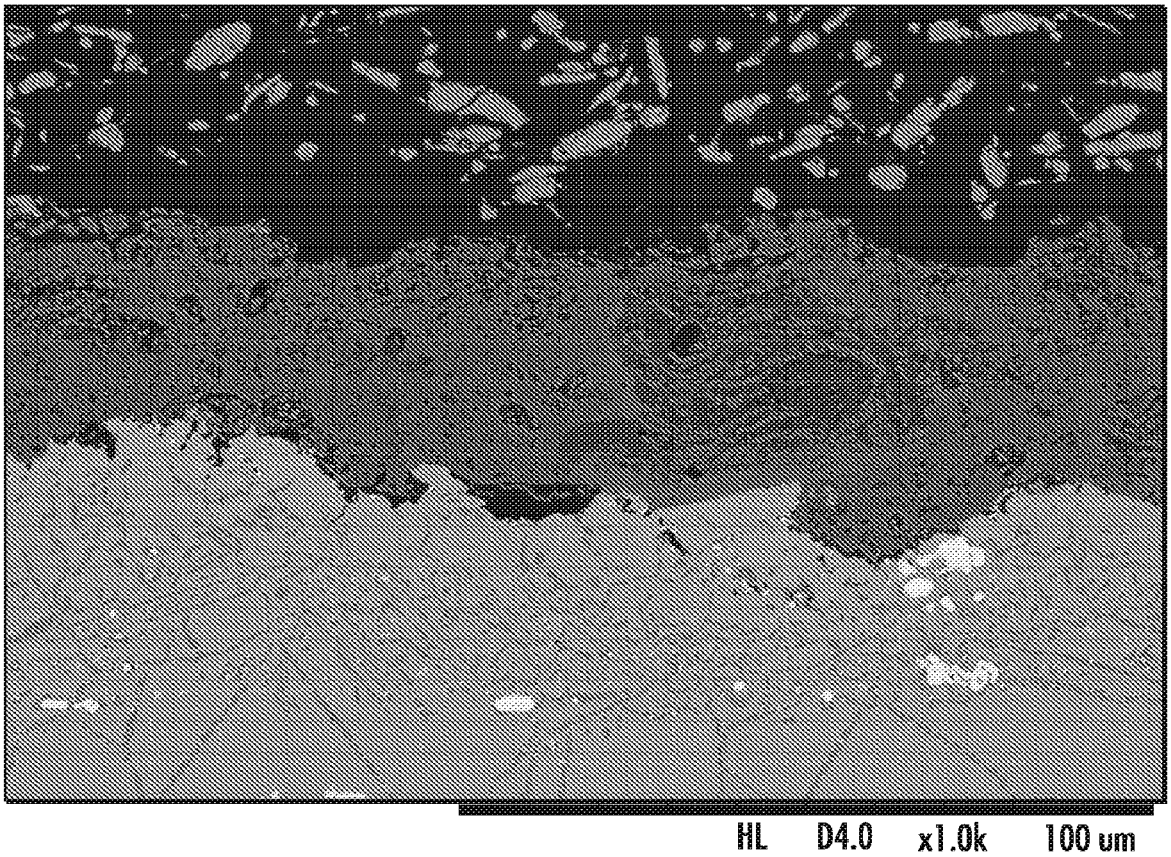
FIGS. 19A-19D illustrate SEM cross-sectional images of carburized plasma-sprayed Cr (6 h), cold-sprayed Cr (6 h), plasma-sprayed Cr (12 h) and cold-sprayed Cr (12 h), coatings respectively.

Due to considerable microstructural differences in as-deposited plasma-sprayed and cold-sprayed Cr it was expected that carburization would lead to vastly different resultant carbide microstructures. Transformations in carbide coating microstructure throughout the carburization process are evidenced in the SEM cross-sectional images of FIGS. 19A-19D. FIGS. 19A-19D illustrate SEM cross-sectional images of carburized: FIG. 19A plasma-sprayed Cr (6 h), FIG. 19B cold-sprayed Cr (6 h), FIG. 19C plasma-sprayed Cr (12 h) and FIG. 19D cold-sprayed Cr (12 h).

Figure 20A:
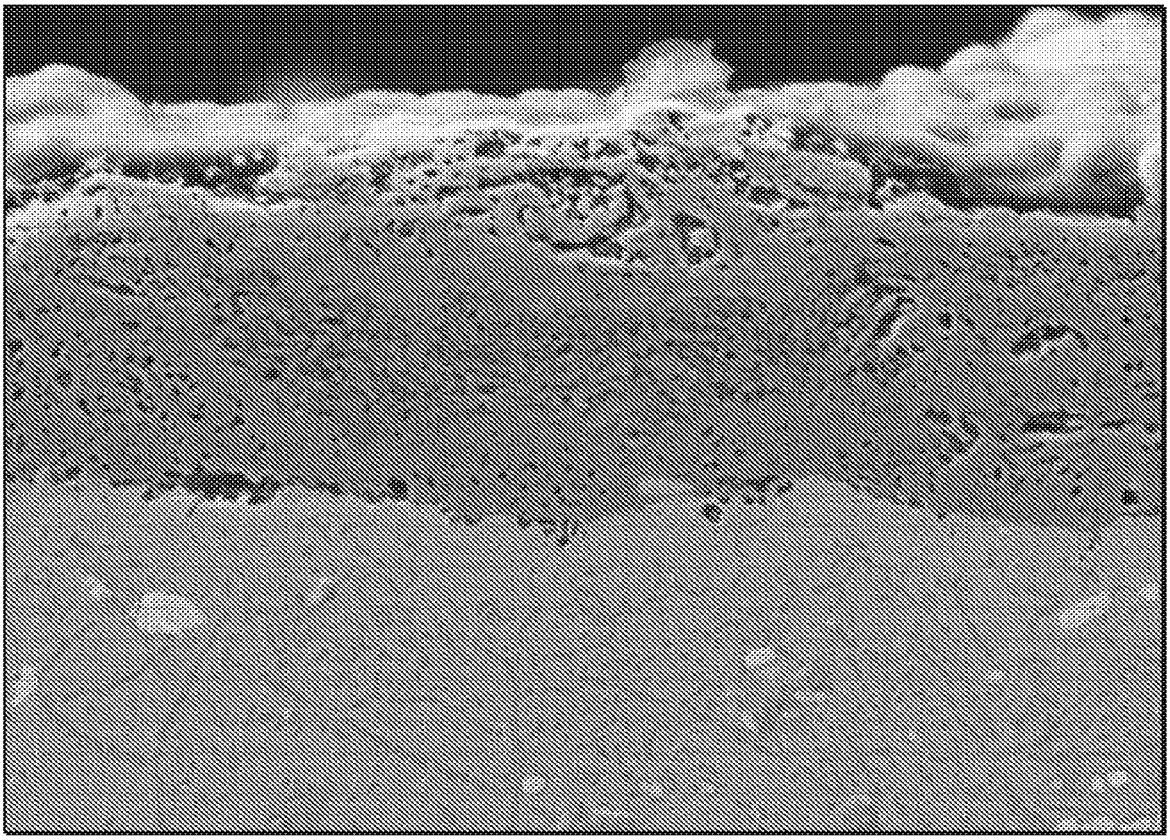
FIGS. 20A-20C illustrate EDS X-ray mapping of the 6 h carburized plasma-sprayed Cr coating; Reference SEM cross-sectional image, EDS X-ray mapping of Cr-K$\alpha$, and EDS X-ray mapping of O-K$\alpha$, respectively.
Figure 20B:
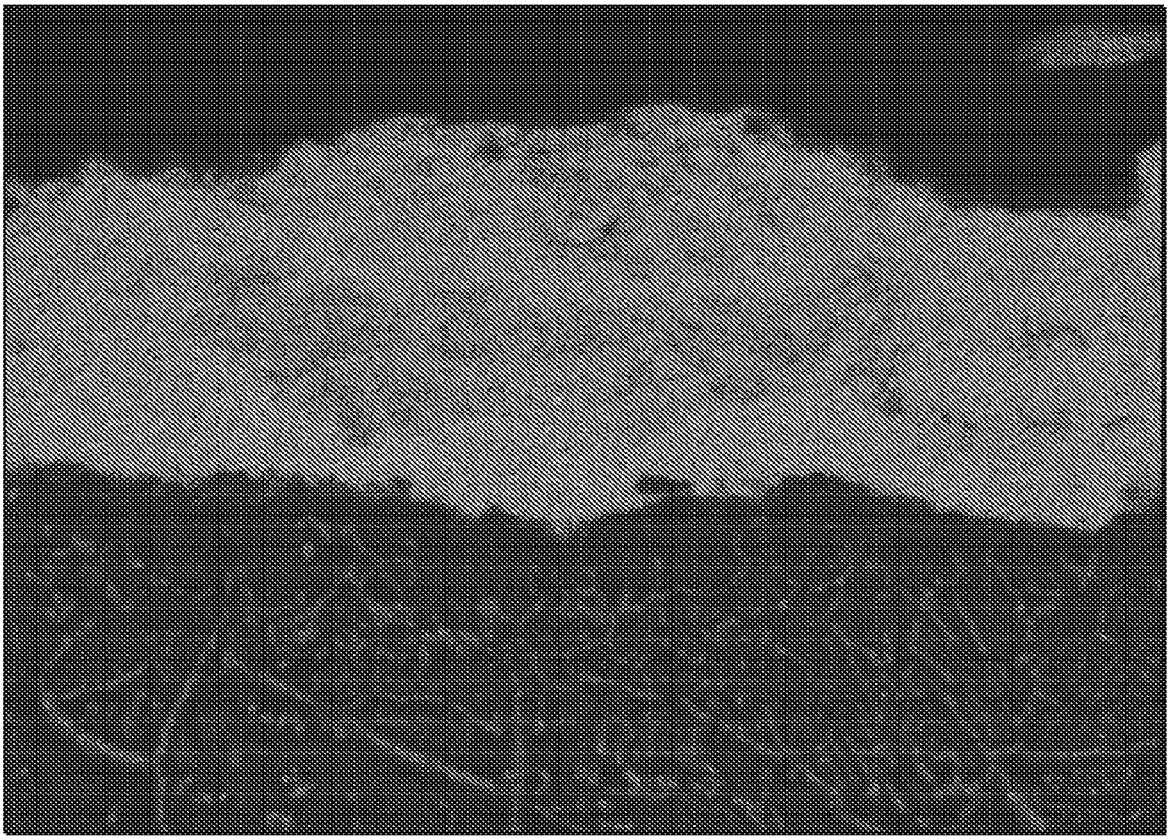
Figure 20C:
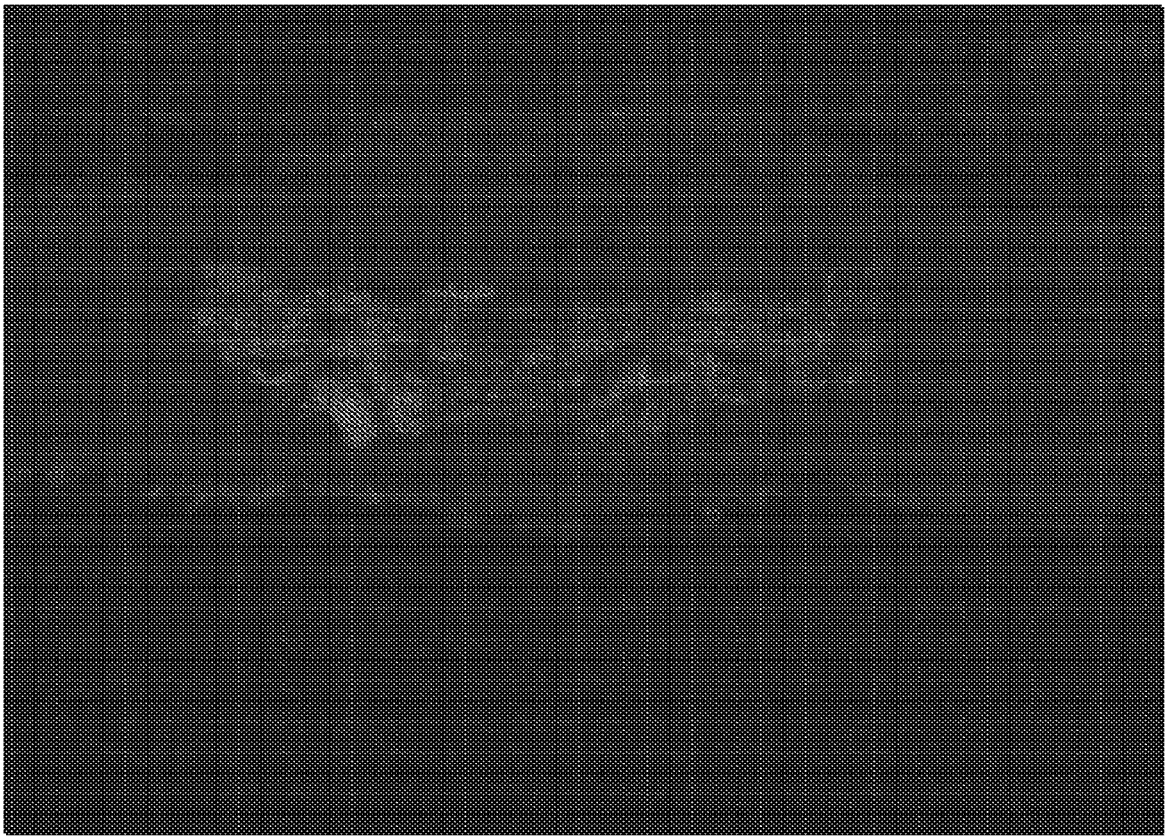

As mentioned previously, as-deposited plasma-sprayed Cr contains globular voids, interlamellar porosity and intralamellar microcracks oriented normal to plane of the coating. After 6 h of carburization the resultant carbide microstructure displays significant deviation from the size, shape and distribution of porosity in the as-deposited coating. Qualitatively speaking, an increase in coating porosity volume fraction appears to accompany the conversion of plasma-sprayed Cr to carbide, which is a noteworthy observation when considering Eq. (12) is associated with an increase in specific volume of 23.57%. It is also apparent from inspection of FIG. 19A that a second impurity phase undetected by XRD is present in the carbide coating and that an effect of the carburization process on the grain boundaries of the H230 substrate (~100 μm penetration depth) has transpired. SEM in conjunction with EDS was implemented to determine the chemical makeup of the second impurity phase, as well as to investigate the origin of the effect of the carburization process on the substrate (FIGS. 20A-20C). FIGS. 20A-20C illustrate EDS X-ray mapping of the 6 h carburized plasma-sprayed Cr coating: FIG. 20A, Reference SEM cross-sectional image, FIG. 20B EDS X-ray mapping of Cr-Kα and FIG. 20C, EDS X-ray mapping of O-Kα.

Figure 19B:
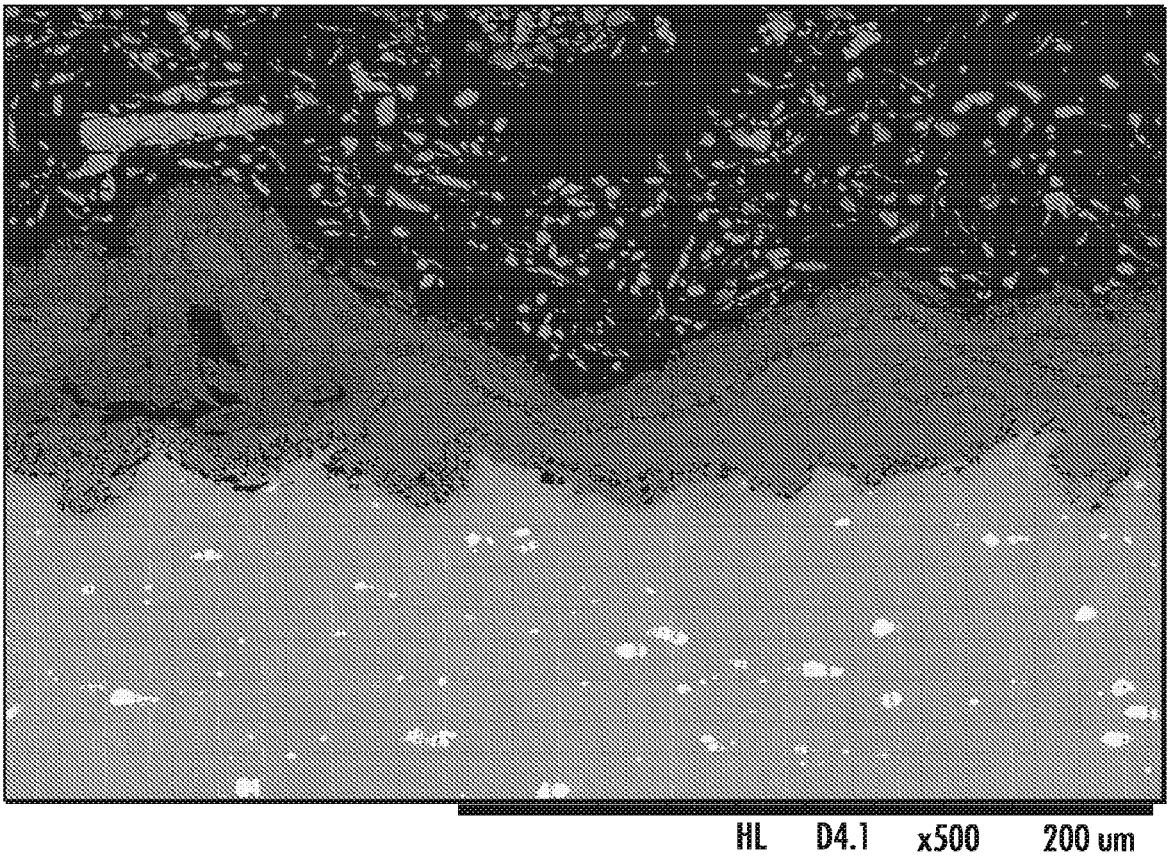
Figure 19C:
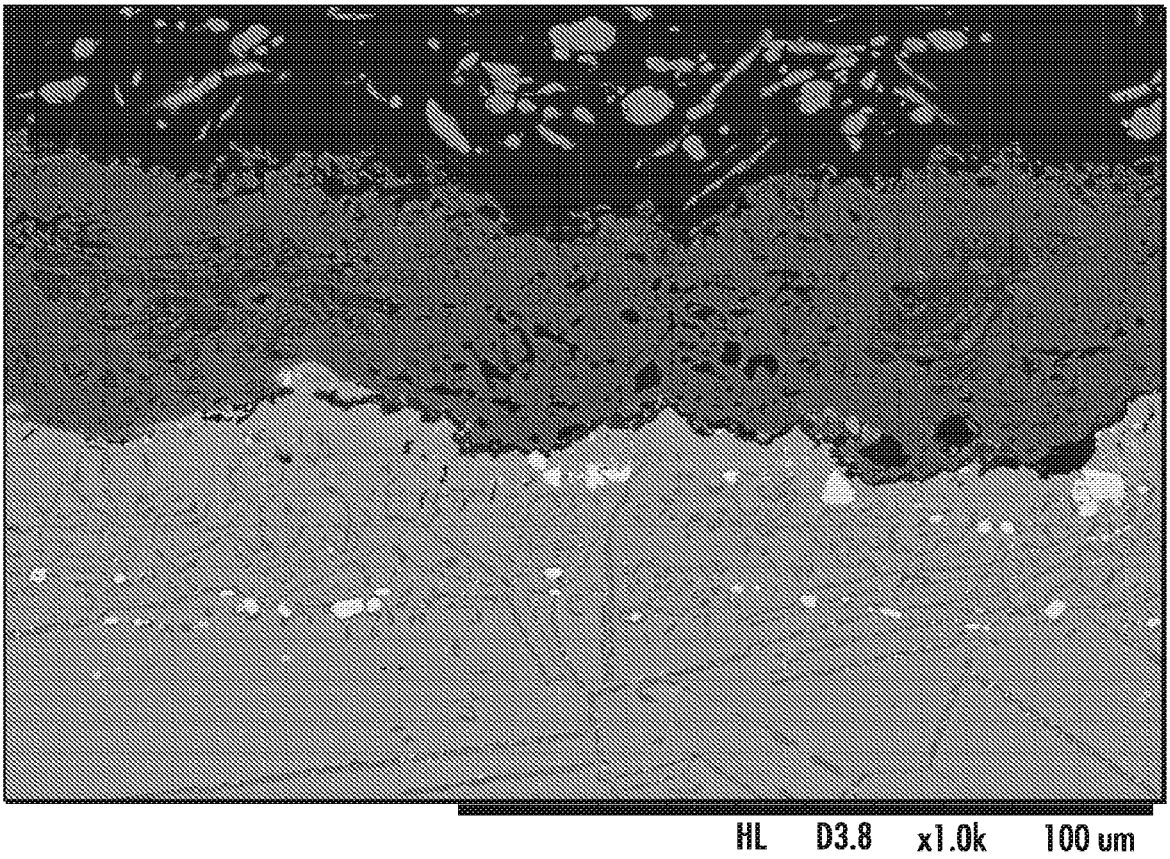

Examination of the EDS X-ray mapping results reveals that the second impurity phase is chromium deficient and oxygen rich relative to the carbide phase. Given the lack of chromium oxide peaks in the XRD pattern of 6 h carburized plasma-sprayed Cr (FIG. 17) it is presumed that the second impurity phase is comprised of an agglomerated amorphous mixture of unconverted chromium and oxygen. The abundance of oxygen in the Cr-rich grain boundaries of the H230 substrate was an unexpected, although consistent, result in the case of plasma-sprayed Cr where the as-deposited partially oxidized Cr coating presents a solid-state source of oxygen for diffusion into the grain boundaries of the substrate prior to conversion to carbide. In agreement with the XRD results presented in FIGS. 17 and 18 no significant microstructural changes in the carbide coating originating from plasma-sprayed Cr were observed with additional carburization time (FIG. 19C). It should be noted that the penetration depth of the substrate effect also remained constant with additional carburization time.

Figure 19D:
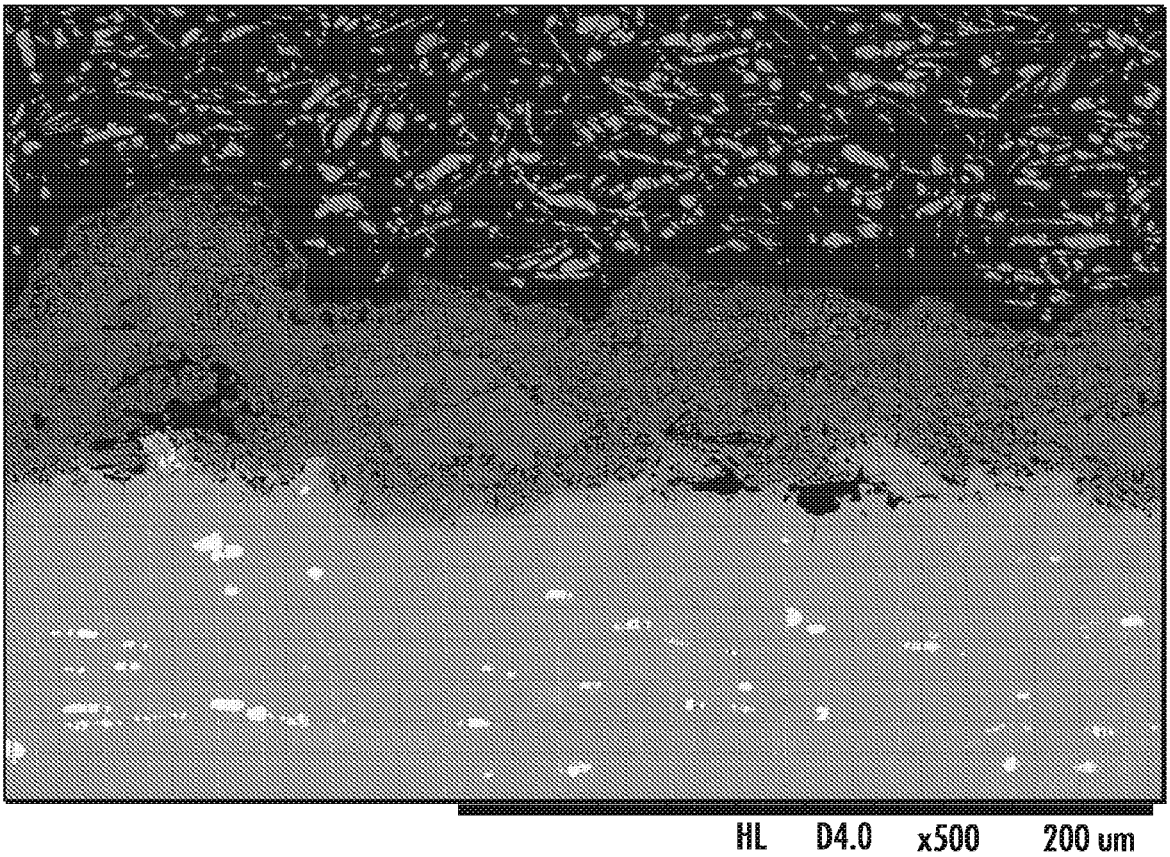

The carburization of cold-sprayed Cr is also accompanied by extensive reorganization of the pore structure in the resultant carbide. For a carburization time of 6 h the interlamellar porosity present in regions of uniform as-deposited coating thickness has been annihilated, presumably by the earlier mentioned increase in specific volume associated with Eq. (12), while pinhole porosity appears to be originating from the coating boundaries (FIG. 19B). As a result, dense mid-layer carbide is formed. In regions of nonuniform as-deposited coating thickness, and necessarily increased porosity, a coalescence of globular voids and interlamellar porosity leads to growth of the globular voids (FIG. 19B). With additional carburization time the pinhole porosity has nearly penetrated through thickness (FIG. 19D). Due to a lack of oxidation in as-deposited cold-sprayed Cr no indication of an effect of the carburization process on the substrate was observed.

Figure 13:
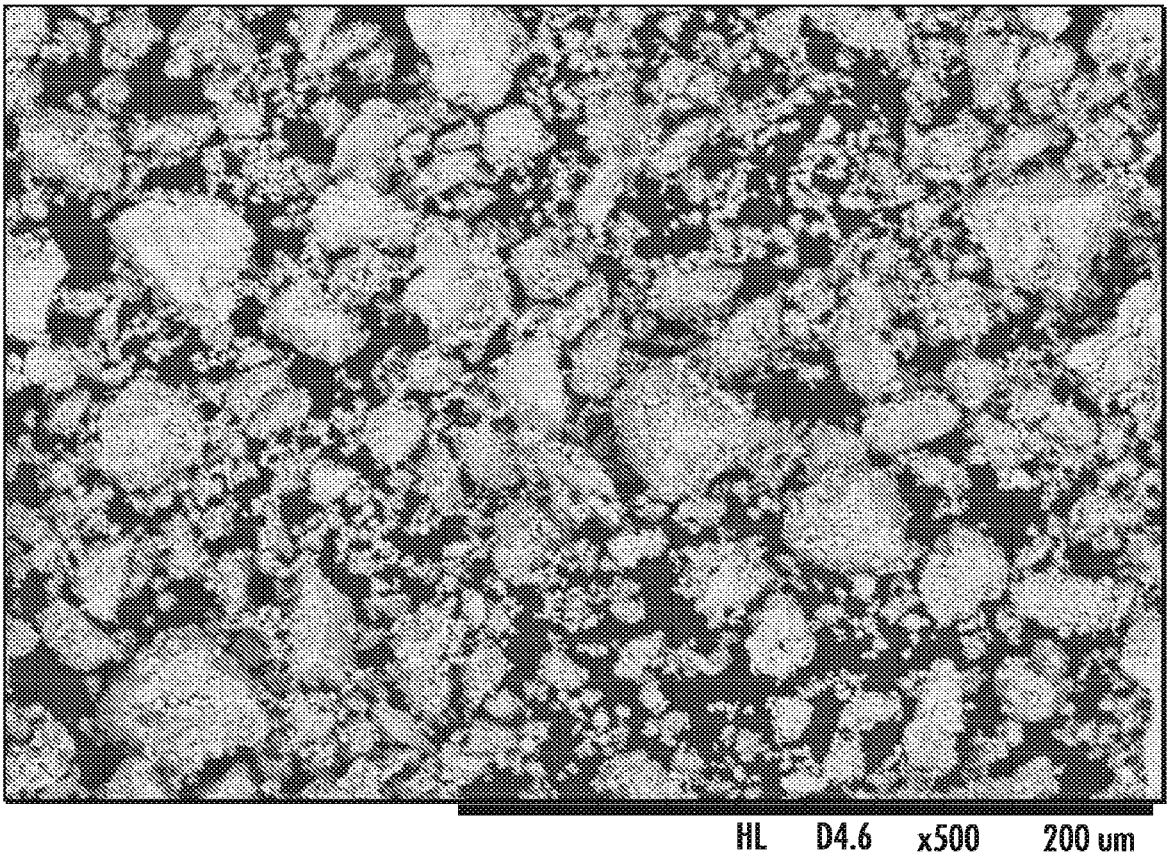
FIG. 13 illustrates an SEM image of a Cr feedstock powder.

The presence of globular voids and interlamellar porosity in as-deposited cold-sprayed Cr was surprising, as metallic deposits developed from this particular thermal spray technique typically display negligible micron-scale porosity. This finding may be due in part to a somewhat bimodal particle size distribution in the Cr feedstock powder (FIG. 13). The effect of feedstock powder particle size/morphology on cold spray in-flight particle velocity has been studied extensively, and it is conceivable that the spherical Cr feedstock particles approaching the limitations of a −45 μm sieve do not reach the critical particle velocity necessary for adherence to the substrate upon impingement under the present deposition conditions. Conversely, the plasma spray technique, which relies on complete or partial in-flight particle melting for adequate bonding upon substrate impingement, is more forgiving of a loosely controlled particle size distribution. The elimination of globular voids in as-deposited cold-sprayed Cr by exercising conscientious selection of feedstock powder characteristics would certainly increase the density of the carbide resulting from the carburization process. As angular/irregular feedstock powders have been shown to exhibit higher in-flight particle velocity relative to same-sized spherical feedstock powders under identical cold spray deposition conditions, future work will probe the use of angular/irregular Cr feedstock material for reduction of globular voids in as-deposited cold-sprayed Cr. The effect of a reduction in as-deposited porosity on the density of carbide coatings resulting from the carburization process will also be investigated.

An unorthodox method for the formation of binder-free $Cr_3C_2$ coatings on nickel-based alloys via the carburization of thermally-sprayed Cr has been considered. Both plasma-sprayed and cold-sprayed Cr displayed successful conversion to $Cr_3C_2$ upon carburization, with the density and the purity of the resultant carbide being strongly influenced by the degree of oxidation in the as-deposited coating. A potentially beneficial effect of the carburization process on the substrate microstructure has been observed in the case of plasma-sprayed Cr. In the interest of forming binder-free $Cr_3C_2$ coatings for molten fluoride salt corrosion resistance, the carburization of thermally-sprayed Cr appears to be an extremely promising technique. Due to the investigative nature of this work, significant room for improvement is evident. Nevertheless, the value of the carburization process for forming corrosion resistant carbide coatings will be explored via future molten fluoride salt immersion studies involving the materials developed herein.

The present invention is also directed to a method of creating refractory coatings with a controlled porosity. The refractory coatings can be formed from a refractory metal, metal oxide, or metal/metal oxide composite refractory coating precursor of the 9 refractory metals encompassed by groups 4-6 and periods 4-6 of the periodic table; non-metallic elements (e.g. Si & B) and their oxides (i.e. $SiO_2$ & $B_2O_3$) are also pertinent. The conversion of the refractory coating precursor to refractory carbide, nitride or boride is achieved via carburization, nitridization, or boridization in the presence of carbon-containing (e.g. $CH_4$), nitrogen containing (e.g. $NH_3$), and boron-containing (e.g. $B_2H_6$) gaseous species respectively. Any known technique of applying the refractory coating precursor can be used, such as thermal spray. The porosity of resultant refractory coatings is controlled through compositional manipulation of composite refractory coating precursors.

The conversion of thermally-sprayed refractory oxides to binder-free carbide, nitride or boride is usually accompanied by a specific volume reduction, which results in a highly microporous, binder-free refractory carbide, nitride or boride coating. These porous refractory matrices can serve as scaffoldings for the formation of multi-functional coatings for a wide range of potential end-use applications. Owing to the relatively high level of microporosity, as well as the relatively uniform pore size and spatial distribution, the pore structure of such refractory matrices can be filled with materials possessing desirable application-oriented properties. Furthermore, refractory carbides, nitrides and borides are well known to exhibit low chemical reactivity at high temperatures. As a result a wide variety of impregnation techniques/materials can be applied to these porous refractory matrices to form multi-functional, permeation-free protective coatings. These include ambient-temperature sealing with organic sealants, filling with sol-gel processed inorganic ceramics, and liquid metal infiltration which requires significantly higher temperatures. Such processes for forming functionally-filled refractory carbide, nitride and boride matrix composites present a unique broad-based business opportunity for customer-driven coatings solutions; as opposed to existing coatings technologies which only seek to serve niche markets.

In an exemplary implementation of the present invention, that is not to be considered limiting, the reduction of atmospheric-plasma-sprayed (APS) $Cr_2O_3$ with methane-containing gas has been investigated. Plasma-sprayed $Cr_2O_3$ coatings were exposed to a flowing, methane-containing atmosphere at 1000° C. to isothermally convert the as-deposited oxide to $Cr_3C_2$. Mechanisms of reduction as well as the minimum reaction times required for complete conversion to $Cr_3C_2$ were investigated using microstructural characterization throughout the reduction process. Measurements were carried out using X-ray diffraction (XRD) and scanning electron microscopy (SEM) to determine phase morphology and porosity evolution in the coating.

Due to the temperature range of interest for $Cr_2O_3$ reduction experiments which exploit methane-containing gas as a reducing agent (800-1200° C.), substrate materials are generally limited to those capable of undergoing short-term, high-temperature exposure without incurring considerable microstructural re-arrangement. These materials include advanced ceramics (e.g. carbon fiber-reinforced carbon) and Ni-based alloys commonly used in high-temperature applications. Since carbon-based materials could act as a supplementary solid-state source of carbon for $Cr_2O_3$ reduction, a Ni-based alloy substrate was selected for this implementation of the invention—Haynes 230 (H230) (Haynes International, Windsor, Conn. 06095, USA). The nominal chemical composition of this alloy is shown in Table 1. Coupons measuring 76.2×25.4×3.175 mm were machined from a H230 sheet (per AMS 5878C) using waterjet cutting. Surface preparations for plasma spraying involved grit blasting with 36 grit $Al_2O_3$, followed by cleaning with isopropyl alcohol and compressed air in an effort to remove adherent oxide particles.

Figure 21A:
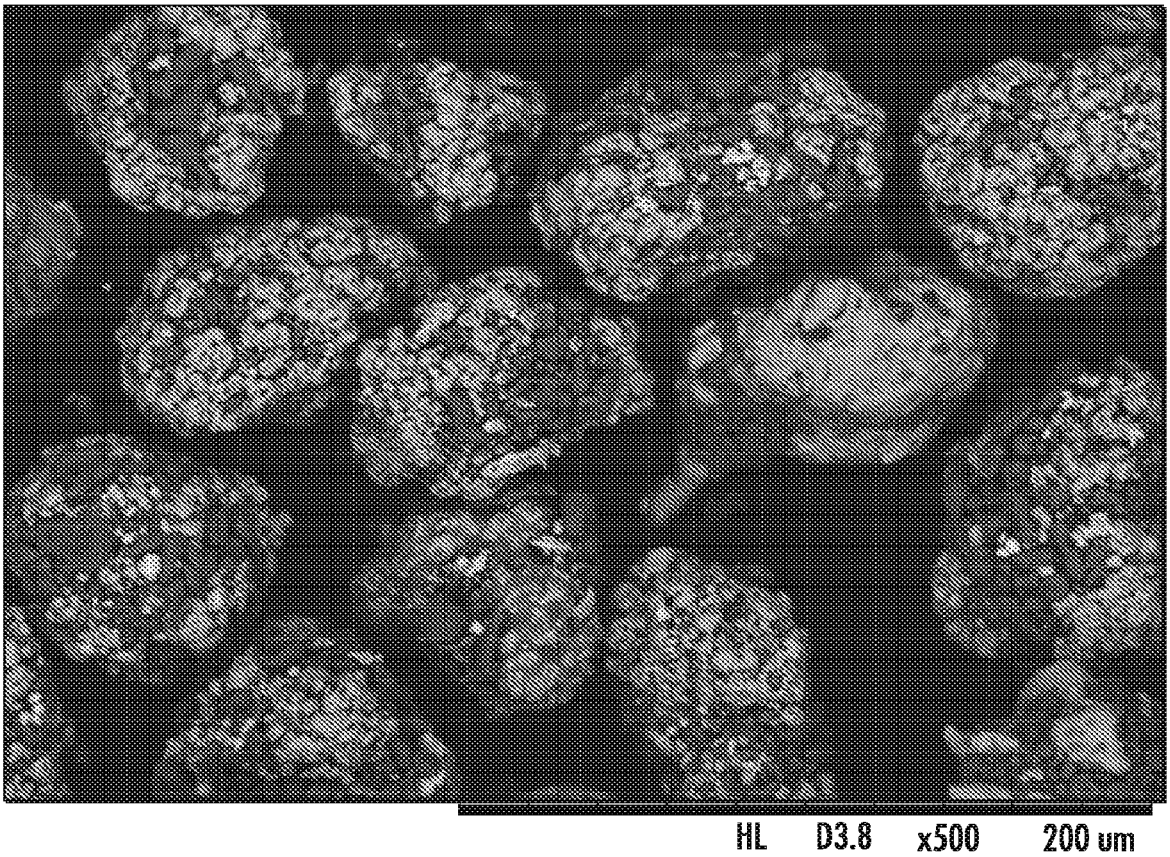
FIGS. 21A and 21B illustrate SEM micrographs of feedstock powder morphologies.
Figure 21B:
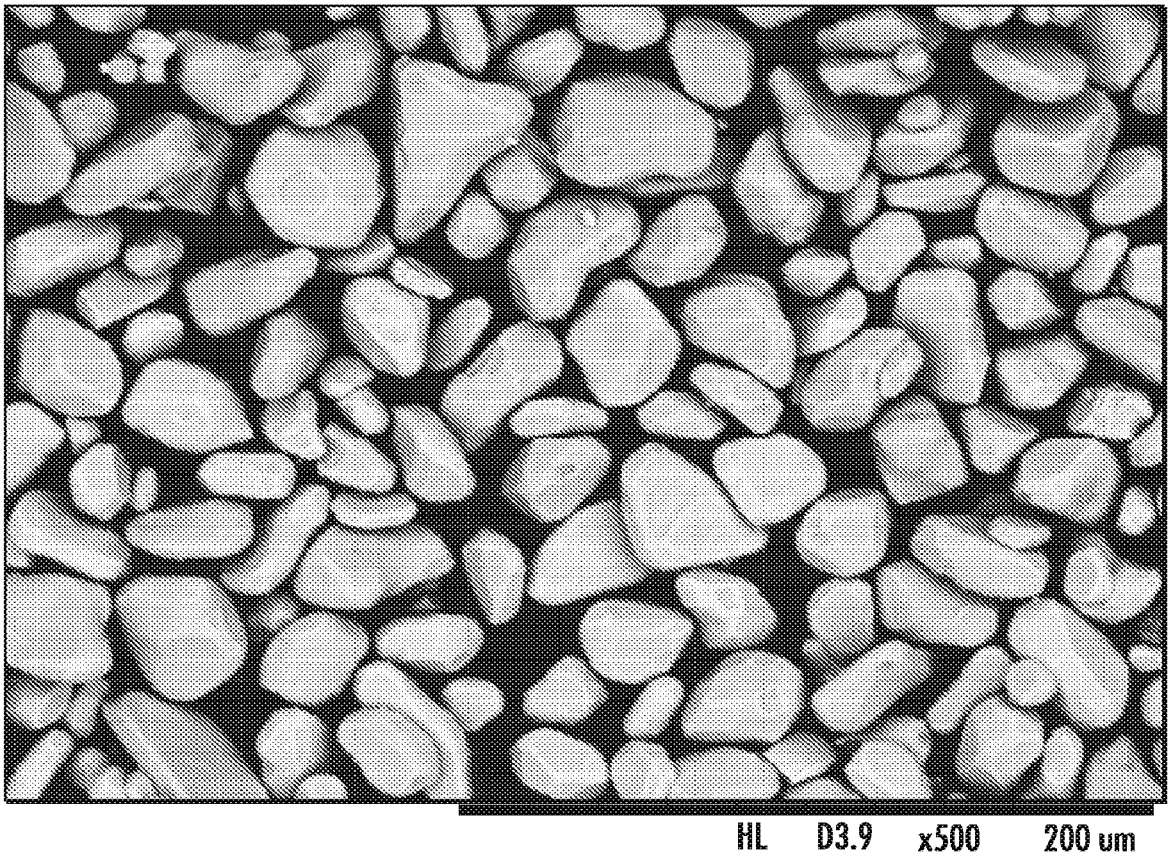

The deposition of $Cr_2O_3$ by means of APS does not require the use of a metallic binder phase (as is the case of thermally-sprayed $Cr_3C_2$), but a bond layer is typically applied between ceramic deposits and metallic substrates to reduce thermal-mismatch stresses that can occur in high-temperature applications. In this work, a NiCr—Al bond layer between the $Cr_2O_3$ top coat and the H230 substrate was used to moderate cracking and spallation of the oxide coating during heating to the reduction temperature (1000° C.). SEM micrographs of the feedstock powders used in this work are shown in FIGS. 21A and 21B and their characteristics are provided in Table 8, below (Metco, Westbury, N.Y. 11590, USA). An APS system consisting of a 9 MB plasma gun (Metco, Westbury, N.Y. 11590, USA), Model 1200 powder feeder (Bay State Surface Technologies, Auburn, Mass. 01501, USA) and HP20 robot movement (Yaskawa Motoman, Miamisburg, Ohio 45342, USA) was used for the deposition of both the NiCr—Al bond layer and the $Cr_2O_3$ top coat. APS deposition conditions are reported in Table 9, below.

TABLE 8

Feedstock Powder Characteristics.

| Feedstock Powder | Chemical Composition (wt. %) | Particle Size (μm) | Morphology |
|---|---|---|---|
| Metco 443NS | Ni 18.5Cr 6Al | −125 +45 | Spherical |
| Amdry 6420 | 99.5+ $Cr_2O_3$ | −45 +22 | Irregular |

TABLE 9

Atmospheric Plasma Spray (APS) Deposition Conditions.

| Feedstock Powder | Voltage (V) | Current (A) | Working Distance (mm) | Traverse Speed (mm/s) | Step Size (mm) |
|---|---|---|---|---|---|
| Metco 443NS | 75 | 500 | 127 | 416.56 | 3.175 |
| Amdry 6420 | 70 | 500 | 69.85 | 416.56 | 3.175 |

Plasma-sprayed $Cr_2O_3$ coatings were exposed to a flowing, methane-containing atmosphere (80 vol. % Ar with 20 vol. % $CH_4$; 250 SCCM) in a horizontal quartz tube (60×64×1300 mm) furnace for 0.1-0.3 h at 1000° C. The system was purged for 3 h with 400 SCCM Ar prior to the initiation of the thermal cycle. Heating and cooling ramps were carried out at a rate of 400° C./h and 200° C./h respectively, with an atmosphere of 200 SCCM Ar. Ultra-high purity gas sources were used in conjunction with an in-line Nanochem Purifilter (Matheson, Basking Ridge, N.J. 07920, USA) to further reduce 02 and $H_2O$ impurity levels (<0.1 ppb $O_2$ and $H_2O$). The gas mixture composition was regulated through the use of Series MC mass flow controllers (Alicat Scientific, Tucson, Ariz. 85743, USA).

The coating phase evolution throughout the reduction process was determined using Xray diffraction with an X'Pert Pro Materials Research Diffractometer (Philips, Andover, Mass. 01810, USA) equipped with a Cu-Kα source. A programmable divergence slit was used to the hold irradiated length constant (8 mm) throughout the scan range thereby increasing the signalto-noise ratio for high-angle diffraction peaks.

Phase morphology and porosity evolution were examined in coating cross sections for various reduction times (0.1-0.3 h) with a TM3000 tabletop SEM (Hitachi, Schaumburg, Ill. 60173, USA). Samples were initially vacuum-impregnated with EpoThin low-viscosity epoxy (Buehler, Lake Bluff, Ill. 60044, USA) at a pressure of 33.6 kPa. Sectioning, grinding and polishing were then performed using the recommended techniques for the metallographic preparation of thermally-sprayed ceramics (ASTM E1920-03). An IsoMet 1000 low-speed precision diamond saw (Buehler, Lake Bluff, Ill. 60044, USA) and an EcoMet 3000/AutoMet 2000 semi-automatic grinder/polisher (Buehler, Lake Bluff, Ill. 60044, USA) were used for sectioning and grinding/polishing respectively.

Figure 22:
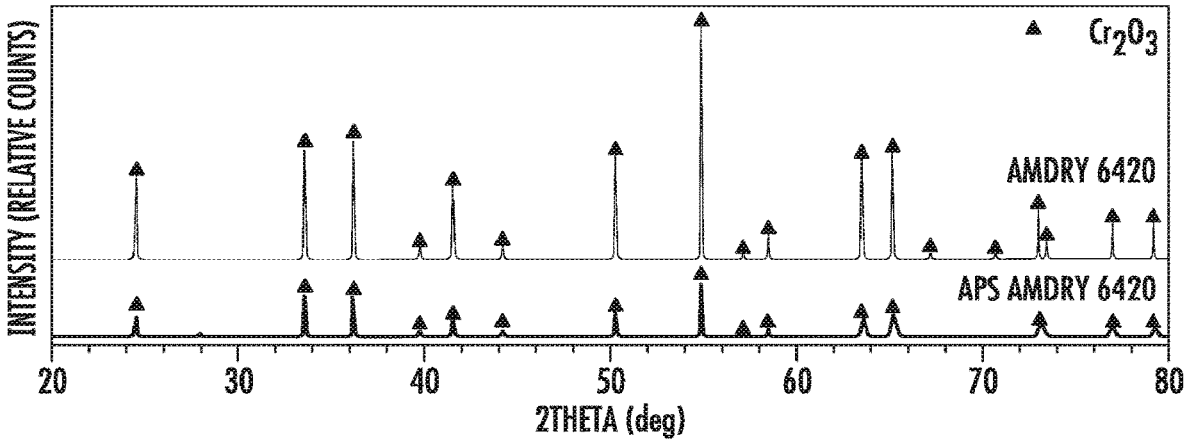
FIG. 22 illustrates a graphical view of XRD patterns of the $Cr_2O_3$ feedstock powder used in this work (top scan) and the resulting plasma-sprayed coating (bottom scan), indicating no appreciable compositional changes as a result of the deposition process.
Figure 23:
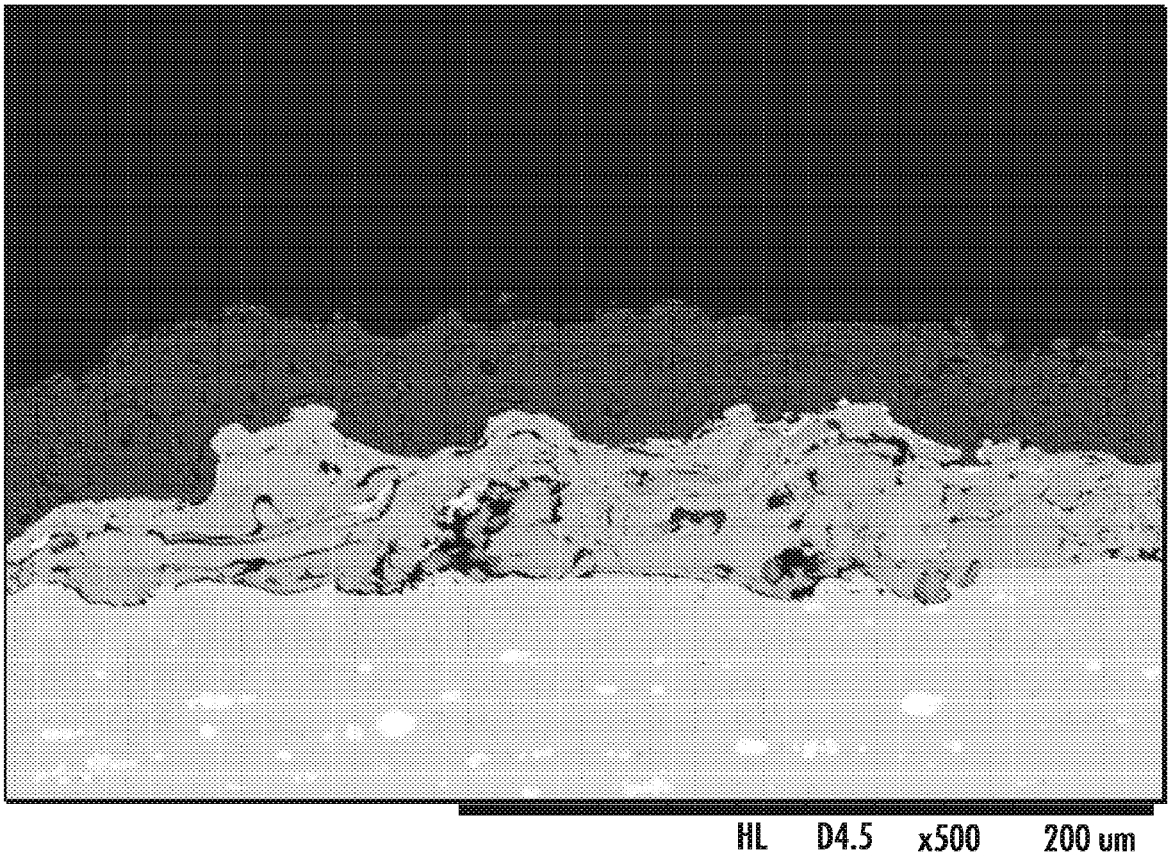
FIG. 23 illustrates a Cross-sectional SEM micrograph of plasma-sprayed $Cr_2O_3$ (top coat), showing a complex pore structure containing globular voids, interlamellar porosity and intralamellar microcracks.

Aspects of the $Cr_2O_3$ reduction process are directly related to the characteristics of the as deposited coating microstructure. XRD measurements of the $Cr_2O_3$ feedstock powder and the resulting plasma-sprayed coating (FIG. 22) indicate no appreciable compositional changes as a result of the deposition process. FIG. 22 illustrates a graphical view of XRD patterns of the $Cr_2O_3$ feedstock powder used in this work (top scan) and the resulting plasma-sprayed coating (bottom scan), indicating no appreciable compositional changes as a result of the deposition process. Although thicker coatings were employed for reduction experiments, the SEM cross-sectional micrograph shown in FIG. 23 is representative of the plasma-sprayed $Cr_2O_3$ used in this work. FIG. 23 illustrates a Cross-sectional SEM micrograph of plasma-sprayed $Cr_2O_3$ (top coat), showing a complex pore structure containing globular voids, interlamellar porosity and intralamellar microcracks. The as-deposited coating microstructure contains globular voids and interlamellar porosity which are characteristic of a wide range of thermally sprayed materials as well as the intralamellar microcracks that occur in brittle ceramics.

Despite uncertainty regarding the mechanism of reduction of $Cr_2O_3$ powder and pressed pellets with methane-containing gas, there is agreement that the conversion to $Cr_3C_2$ largely proceeds by the following overall reaction:

$$3Cr_2O_3(s)+13CH_4(g)\rightarrow 2\ Cr_3C_2(s)+9CO(g)+26H_2(g) \quad (14)$$

Figure 24:
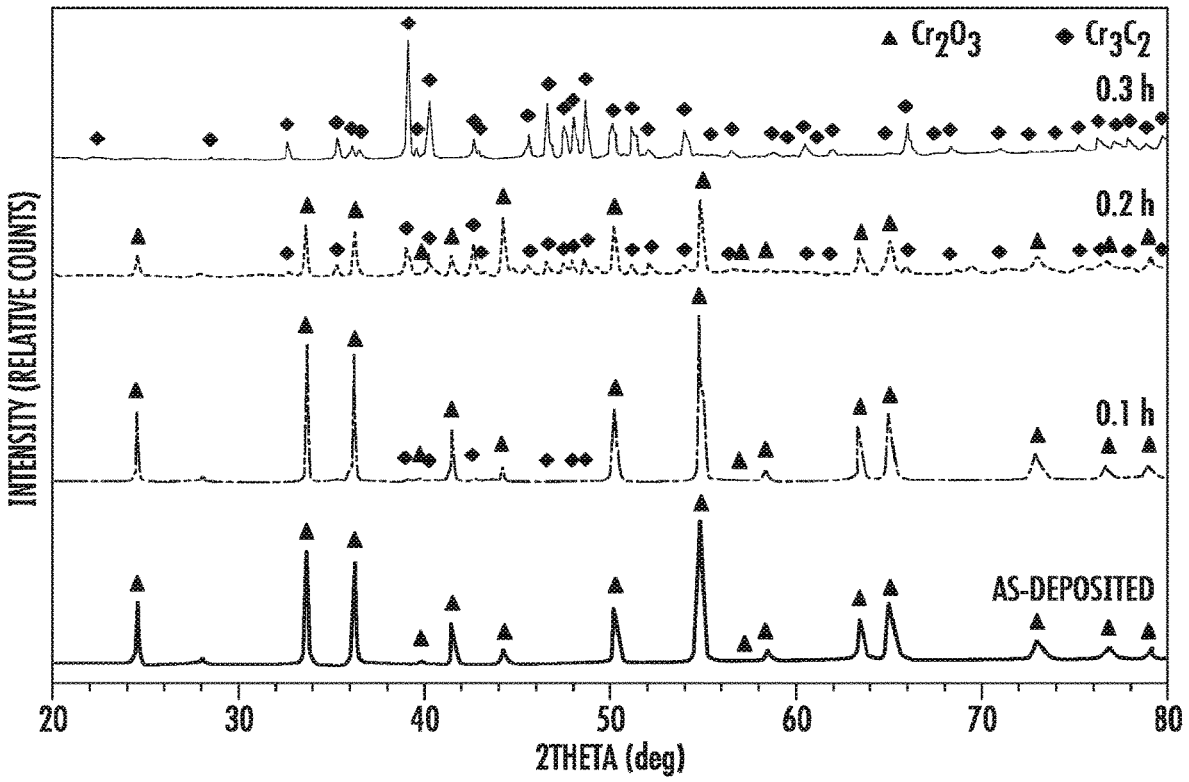
FIG. 24 illustrates a graphical view of XRD patterns of plasma-sprayed $Cr_2O_3$ after various reduction times (0.1-0.3 h) at 1000° C., showing coating phase evolution from $Cr_2O_3$ to binder-free $Cr_3C_2$.

In this work, it was found that the complete conversion of plasma-sprayed $Cr_2O_3$ to $Cr_3C_2$ occurred over timescales similar to those reported in related work which exploited vapor-phase reducing agents, but differed significantly from those reported for solid-state carbothermal reduction investigations. The XRD patterns in FIG. 24 show the coating phase evolution for reduction times of 0.1-0.3 h at 1000° C. FIG. 24 illustrates a graphical view of XRD patterns of plasma-sprayed $Cr_2O_3$ after various reduction times (0.1-0.3 h) at 1000° C., showing coating phase evolution from $Cr_2O_3$ to binder-free $Cr_3C_2$.

For a reduction time of 0.1 h, the onset of $Cr_3C_2$ formation is observable while $Cr_2O_3$ clearly remains the major phase in the coating. With increased reduction time (0.2 h), it is apparent a substantial volume fraction of the $Cr_2O_3$ coating is converted to $Cr_3C_2$. After 0.3 h, the conversion to $Cr_3C_2$ is complete (to the penetration depth of the X-ray beam), and an XRD pattern with relative intensities closely matching randomly oriented, polycrystalline $Cr_3C_2$ is achieved. These measurements demonstrate the ability to form binder-free $Cr_3C_2$ coatings via reduction of plasma-sprayed $Cr_2O_3$ with methane-containing gas—this is one of the principal results of this work. Previous investigation has shown the initial porosity in sprayed Cr coatings affects the carburization process, and it is conceivable that defects in plasma-sprayed $Cr_2O_3$ could serve a similar role in achieving through-thickness conversion. The SEM micrographs in FIGS. 25A-25C illustrate SEM image views of the coating phase morphology and porosity evolution throughout the reduction process, and illustrate characteristics of the mechanism of reduction with methane-containing gas when employing a plasma-sprayed $Cr_2O_3$ coating precursor.

Figure 25A:
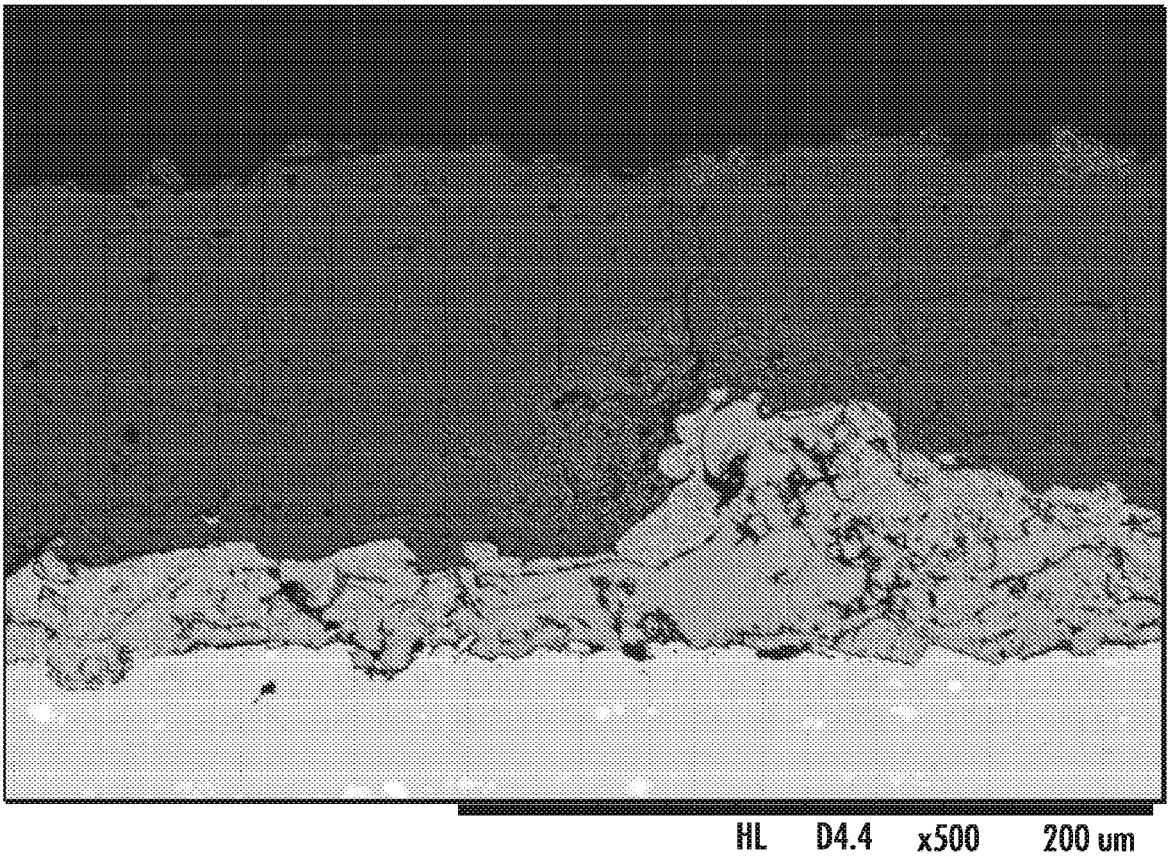
FIGS. 25A-25C illustrate cross-sectional SEM micrographs of plasma-sprayed $Cr_2O_3$ after various reduction times at 1000° C., illustrating characteristics of the mechanism of reduction to binder-free $Cr_3C_2$.
Figure 25B:
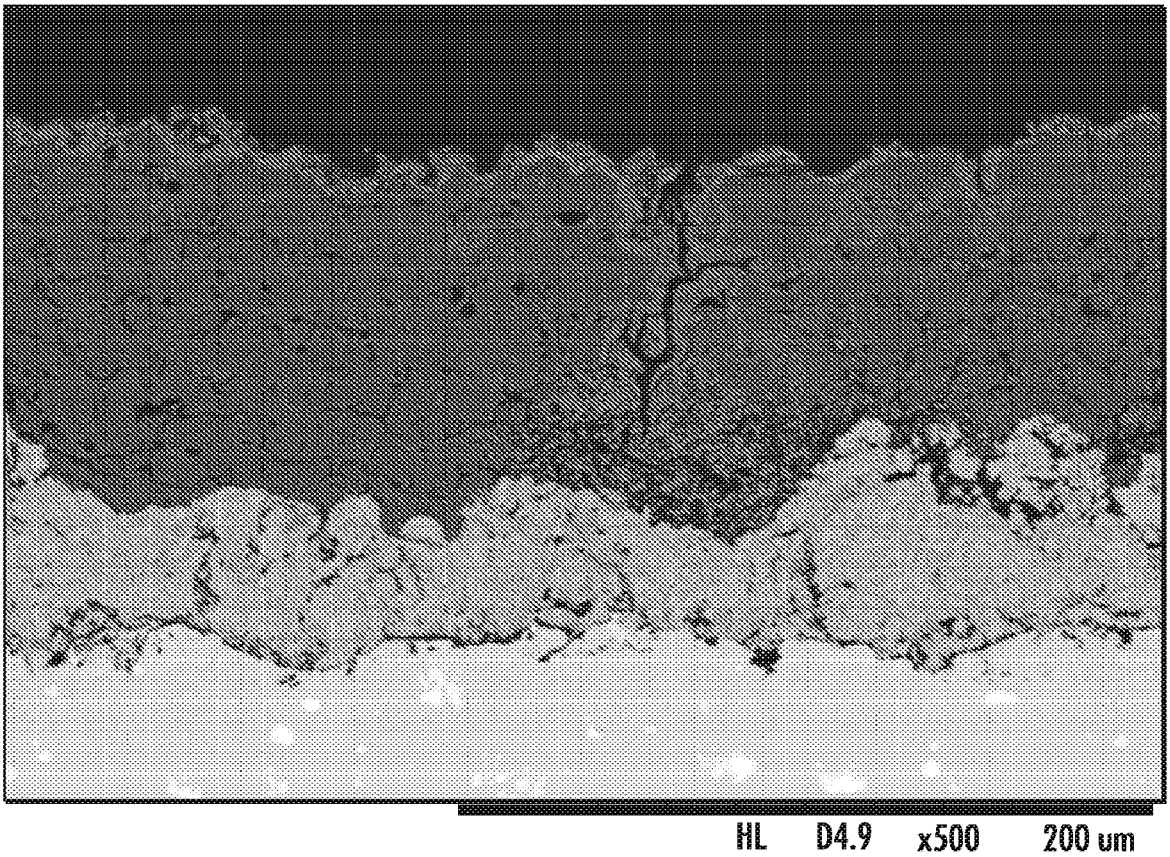
Figure 25C:
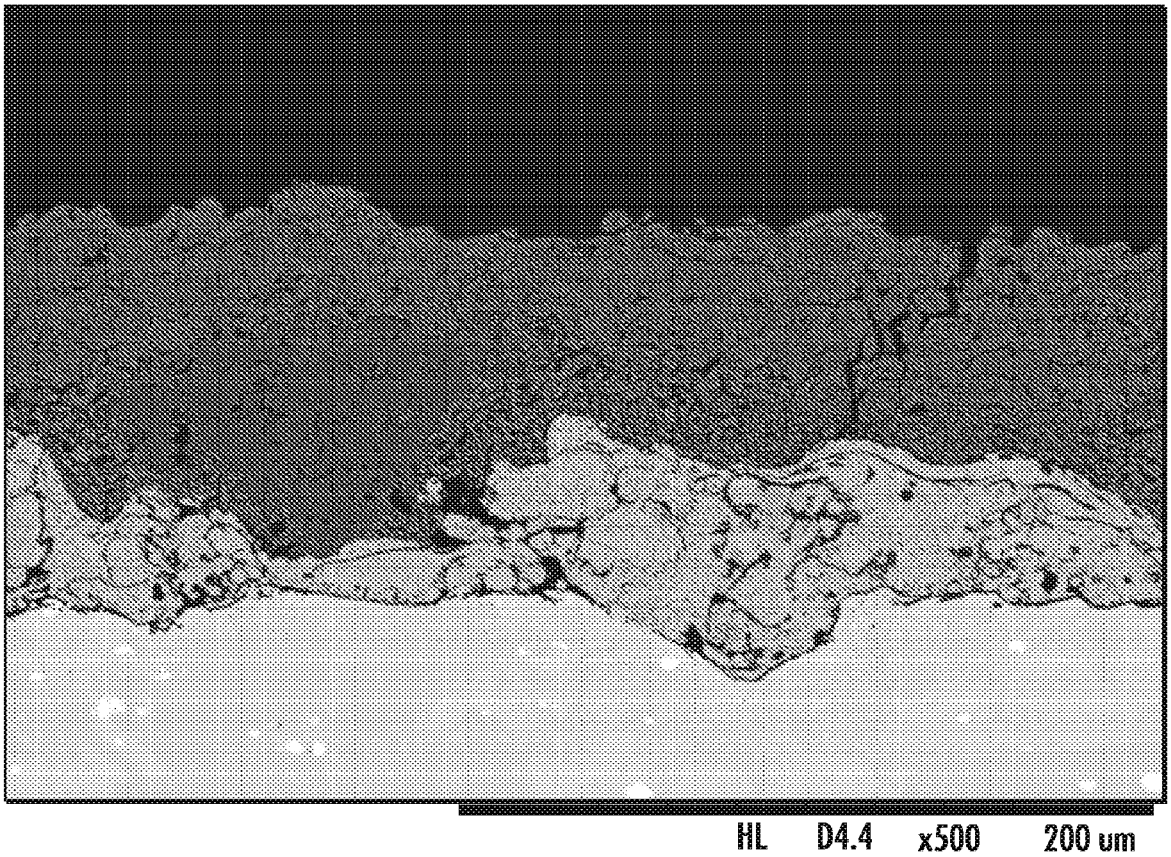
Figure 26:
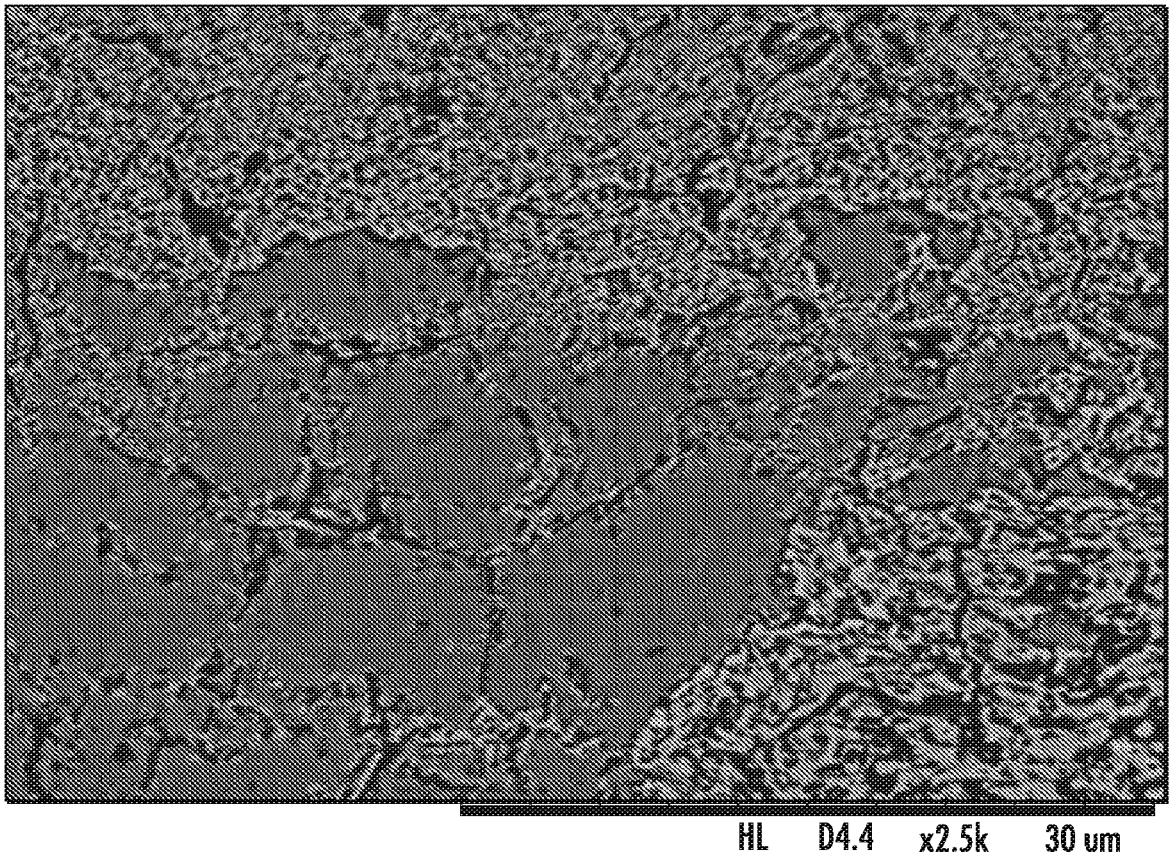
FIG. 26 illustrates an SEM image view of void formation in the $Cr_3C_2$ phase formed from the reduction of plasma-sprayed $Cr_2O_3$.

FIGS. 25A-25C illustrate cross-sectional SEM micrographs of plasma-sprayed $Cr_2O_3$ after various reduction times at 1000° C., illustrating characteristics of the mechanism of reduction to binder-free $Cr_3C_2$: FIG. 25A illustrates 0.1 h, FIG. 25B illustrates 0.2 h, and FIG. 25C illustrates 0.3 h. At the earliest reduction time (0.1 h) the onset of $Cr_3C_2$ formation (visible in areas of increased image brightness relative to the surrounding unconverted $Cr_2O_3$) appears to be limited to the near-surface region of the coating and to areas containing sizeable microcracks oriented normal to the plane of the coating (FIG. 25A). Considering that the out-of-plane dimensions of these microcracks far exceed splat thicknesses and also that they were not present in the as-deposited $Cr_2O_3$ coating microstructure (FIG. 23), it is likely they result from thermal-mismatch stresses generated by heating to the reduction temperature (1000° C.). Even though the NiCr—Al bond layer did not prevent microcracking, the enhanced rate of reduction in the vicinity of microcracks indicates that defects in plasma-sprayed $Cr_2O_3$ facilitate through-thickness conversion. Inspection of FIG. 25B for a reduction time of 0.2 h further suggests that multiple pathways for reduction are acting. While reduction seems to proceed in-plane by means of thermal-stress-generated microcracks, carbide formation also occurs progressively from the surface to underlying unconverted $Cr_2O_3$ in other regions of the coating microstructure. Although the imaging results for a reduction time of 0.3 h (FIG. 25C) agree with the XRD measurements presented in FIG. 24 (the $Cr_3C_2$ surface layer thickness exceeds the X-ray beam penetration depth) an underlying portion of oxide remains unconverted in regions of increased $Cr_2O_3$ thickness. In areas of the microstructure containing thermal-stress-generated microcracks, carbide formation has progressed through the coating thickness. Closer examination of the interface between the $Cr_3C_2$ surface layer and the underlying unconverted $Cr_2O_3$ in FIG. 25C reveals a significant difference in porosity between the two phases (FIG. 26). FIG. 26 illustrates an SEM image view of void formation in the $Cr_3C_2$ phase formed from the reduction of plasma-sprayed $Cr_2O_3$. Void formation of similar character has been documented in previous work involving the conversion of $Cr_2O_3$ powder to $Cr_3C_2$ via reduction with methane-containing gas; however, in this particular instance it is probable that the newly-formed microporous $Cr_3C_2$ is a combined result of the constraint on coating dimensions imposed by the substrate and the specific volume decrease associated with Eq. 14 (38.1%). Irrespective of the coating location under consideration, a thick, continuous surface layer of adherent, binder-free $Cr_3C_2$ is formed after a reduction time of 0.3 h.

Although thermogravimetric or on-line off-gas mass spectroscopy techniques will be needed to quantify the reaction kinetics of the reduction of plasma-sprayed $Cr_2O_3$ with methane containing gas, a qualitative understanding can be gained from the XRD and SEM results presented in FIGS. 24 and 25A-25C. Because non-catalytic gas-solid reactions are inherently multi-step phenomena, both chemical and physical (diffusional) processes must be considered when identifying the rate-limiting step in the overall reaction. The lack of diffraction peaks belonging to carbon in the XRD patterns for all of the reduction times in this work (FIG. 24) suggests the newly-formed microporous $Cr_3C_2$ is a non-catalytic surface for methane decomposition. Also, this lack of carbon deposition indicates that the diffusion of reducing agents rather than their chemical reactivity is probably the rate-limiting step in the overall reaction. This notion contrasts with previous modeling involving the reaction kinetics of the reduction of pressed $Cr_2O_3$ pellets with methane-containing gas, which operated under the assumption that chemical reactivity was the rate-limiting step. However, the low-density pressed pellets were formed from an initially porous $Cr_2O_3$ powder of high surface area which likely resulted in a physical system that supported such a model. Regardless of the rate-limiting step under consideration, the progression of conversion over time (FIGS. 25A-25C) seems to indicate that the overall reaction extent is non-linear in nature when employing a plasma-sprayed $Cr_2O_3$ coating precursor. This is in agreement with previous work using $Cr_2O_3$ powder and pressed pellets which quantified the extent of overall reactions under isothermal conditions. In addition, the timescale over which complete conversion occurs (less than 0.5 h) compares favorably with these previous reports—this was unexpected considering the large differences in density between the powder, pressed pellet and plasma-sprayed $Cr_2O_3$ preforms.

Also of significance is the disparity between the timescales required for the complete conversion of plasma-sprayed Cr and $Cr_2O_3$ to $Cr_3C_2$ under identical conditions. In this work the complete conversion of plasma-sprayed $Cr_2O_3$ to $Cr_3C_2$ is realized in less than 0.5 h, whereas previous investigation involving the carburization of plasma-sprayed Cr suggested that complete conversion required at least several hours. A fundamental difference in the mechanism of conversion is probably responsible for this discrepancy. While microcracking in the $Cr_2O_3$ coating defect structure facilitates rapid through-thickness reducing agent penetration, subsequent transport is likely occurring by means of methane gas diffusion through microporosity in the newly-formed $Cr_3C_2$ in order to reach unconverted oxide. Specific models will be needed to confirm a self-assisted conversion mechanism of this nature.

The expeditious conversion of plasma-sprayed $Cr_2O_3$ to $Cr_3C_2$ may point towards directions for the rapid synthesis of other binder-free refractory carbide coatings of industrial importance, such as tungsten carbide (WC). The conversion of tungsten oxide ($WO_3$) powder to WC via reduction with methane-containing gas has been shown to result in an increase in particle porosity; therefore, it is likely that plasma-sprayed $WO_3$ would follow a reduction mechanism similar to what has been observed in the instance of plasma-sprayed $Cr_2O_3$. Future efforts should involve investigating the ability to convert the remaining group IV-VI refractory oxides to binder-free carbide in order to further substantiate the significance of this processing technique.

The present invention demonstrates a method for the synthesis of binder-free $Cr_3C_2$ coatings on nickel-based alloys via the reduction of plasma-sprayed $Cr_2O_3$ with methane-containing gas. A thick, continuous surface layer of adherent, binder-free $Cr_3C_2$ has been achieved, with the mechanism of reduction being strongly influenced by the coating defect structure at the reduction temperature.

Despite large differences in density between oxide preforms, the conversion of plasma-sprayed $Cr_2O_3$ to $Cr_3C_2$ reported here occurs over timescales similar to those in related work which used $Cr_2O_3$ power and pressed pellets. This might be due in part to the formation of microporosity in the newly-formed $Cr_3C_2$ which appears to expedite the diffusion of methane gas to unconverted $Cr_2O_3$. Beyond playing a significant role in the mechanism of reduction, microporous $Cr_3C_2$ could serve as fracture resistant, refractory scaffolding for lubricants in high-temperature abrasive wear applications.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of forming a refractory coating comprising:
applying a refractory coating precursor to a surface using a spray technique;
introducing a gaseous species in proximity to the refractory coating precursor; and
generating thermal decomposition of the gaseous species to form a refractory coating on the surface, the refractory coating comprising a final total porosity of about 1% to about 50% by volume of the refractory coating; and
impregnating the refractory coating to form a multi-functional coating.

2. The method of claim 1, further comprising using one of a group consisting of refractory metal, metal oxide, and metal/metal oxide composite as a refractory coating precursor.

3. The method of claim 1, further comprising using a gaseous species selected from a group consisting of carbon-containing, nitrogen-containing, and boron containing gaseous species.

4. The method of claim 1, further comprising using plasma spray.

5. The method of claim 1, further comprising using cold spray.

6. The method of claim 1, further comprising forming one of a group consisting of refractory carbide, nitride, and boride coatings or any combination thereof.

7. The method of claim 1, wherein the refractory coating precursor comprises a refractory metal selected from a group consisting of titanium, vanadium, chromium, zirconium, niobium, molybdenum, halfnium, tantalum, and tungsten.

8. The method of claim 1, wherein the refractory coating precursor comprises chromium.

9. The method of claim 1, wherein the refractory coating precursor comprises silicon, boron, or a combination thereof.

10. The method of claim 1, further comprising forming $Cr_3C_2$.

11. The method of claim 1, wherein the gaseous species comprises methane.

12. A method of forming a refractory coating comprising:
applying a refractory coating precursor to a surface using thermal spraying;
introducing a gaseous species in proximity to the refractory coating precursor;
generating thermal decomposition of the gaseous species resulting in the refractory coating defining a porous refractory matrix;
using the porous refractory matrix as a scaffold for the formation of a multi-functional coating; and
creating the multi-functional coating using ambient-temperature sealing with organic sealants, filling with sol-gel processed inorganic ceramics, liquid metal infiltration or a combination thereof; and
wherein the formed refractory coating has a final total porosity of about 1% to about 50% by volume of the refractory coating.

13. The method of claim 12, further comprising using one of a group consisting of refractory metal, metal oxide, and metal/metal oxide composite as a refractory coating precursor.

14. The method of claim 12, further comprising using plasma spray.

15. The method of claim 12, further comprising using one or more selected from a group consisting of carbon-containing, nitrogen-containing, and boron containing gaseous species.

16. The method of claim 12, further comprising forming one of a group consisting of refractory carbide, nitride, and boride coatings, or any combination thereof.

17. The method of claim 12, wherein the refractory coating precursor comprises a refractory metal selected from a group consisting of titanium, vanadium, chromium, zirconium, niobium, molybdenum, halfnium, tantalum, and tungsten.

18. The method of claim 12, wherein the refractory coating precursor comprises silicon, boron, or a combination thereof.

19. The method of claim 12, further wherein the porous refractory matrix comprises $Cr_3C_2$.

* * * * *